US011656570B2

(12) United States Patent
Sato et al.

(10) Patent No.: US 11,656,570 B2
(45) Date of Patent: May 23, 2023

(54) IMAGE FORMING APPARATUS

(71) Applicant: BROTHER KOGYO KABUSHIKI KAISHA, Nagoya (JP)

(72) Inventors: Shougo Sato, Seto (JP); Naomichi Kobayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/474,155

(22) Filed: Sep. 14, 2021

(65) Prior Publication Data

US 2021/0405573 A1 Dec. 30, 2021

Related U.S. Application Data

(63) Continuation of application No. 16/907,465, filed on Jun. 22, 2020, now Pat. No. 11,144,004, which is a (Continued)

(30) Foreign Application Priority Data

Jul. 9, 2018 (JP) ..... JP2018-129805

(51) Int. Cl.
*G03G 21/12* (2006.01)
*G03G 21/10* (2006.01)
(Continued)

(52) U.S. Cl.
CPC ..... *G03G 21/12* (2013.01); *G03G 15/0875* (2013.01); *G03G 15/166* (2013.01);
(Continued)

(58) Field of Classification Search
CPC ..... G03G 15/0865; G03G 15/0875; G03G 21/10; G03G 21/105; G03G 21/12; G03G 2221/1684
See application file for complete search history.

(56) References Cited

U.S. PATENT DOCUMENTS 5,617,195 A 4/1997 Torimaru et al.
8,543,033 B2 9/2013 Morishita
(Continued)

FOREIGN PATENT DOCUMENTS

JP 59-126584 A 7/1984
JP 63-247763 A 10/1988
(Continued)

OTHER PUBLICATIONS

Notice of Reasons for Refusal issued in related Japanese application No. 2018-129805, dated Apr. 26, 2022.
(Continued)

*Primary Examiner* — Carla J Therrien
(74) *Attorney, Agent, or Firm* — Merchant & Gould P.C.

(57) ABSTRACT

An image forming apparatus includes: a drawer movable between an inner position and an outer position and supporting a first cartridge including a first photosensitive drum and a first discharge part and a second cartridge including a second photosensitive drum and a second discharge part; and a waste toner box including a first coupling part coupled with the first discharge part and a second coupling part coupled with the second discharge part, in a state where the first cartridge and the second cartridge are supported by the drawer at an inner position and the waste toner box is mounted to the apparatus main body, the waste toner box being movable between a first/second position where the first coupling part and the first discharge part are coupled/decoupled and the second coupling part and the second discharge part are coupled/decoupled.

14 Claims, 14 Drawing Sheets

Related U.S. Application Data continuation of application No. 16/459,726, filed on Jul. 2, 2019, now Pat. No. 10,725,423.

(51) Int. Cl.
*G03G 15/16* (2006.01)
*G03G 21/16* (2006.01)
*G03G 15/08* (2006.01)

(52) U.S. Cl.
CPC ..... *G03G 21/105* (2013.01); *G03G 21/1623* (2013.01); *G03G 2215/1652* (2013.01); *G03G 2215/1657* (2013.01); *G03G 2215/1661* (2013.01); *G03G 2221/1684* (2013.01); *G03G 2221/1869* (2013.01)

(56) References Cited

U.S. PATENT DOCUMENTS

| | | | |
|---|---|---|---|
| 2003/0081969 | A1 | 5/2003 | Muramatsu et al. |
| 2006/0072947 | A1 | 4/2006 | Marin et al. |
| 2006/0193648 | A1 | 8/2006 | Kadowski et al. |
| 2007/0059048 | A1* | 3/2007 | Yoon ..... G03G 15/0812 399/284 |
| 2009/0097879 | A1 | 4/2009 | Nagashima et al. |
| 2009/0297208 | A1 | 12/2009 | Suzuki et al. |
| 2010/0247142 | A1 | 9/2010 | Kikuchi et al. |
| 2011/0123207 | A1 | 5/2011 | Sato et al. |
| 2012/0076534 | A1 | 3/2012 | Sato |
| 2014/0294439 | A1 | 10/2014 | Kawahara |
| 2015/0147088 | A1 | 5/2015 | Sato et al. |
| 2015/0147090 | A1 | 5/2015 | Sato et al. |
| 2016/0274534 | A1 | 9/2016 | Shiba |
| 2016/0349667 | A1 | 12/2016 | Imaizumi |
| 2017/0023908 | A1 | 1/2017 | Miura et al. |
| 2017/0269539 | A1 | 9/2017 | Komiyama et al. |

FOREIGN PATENT DOCUMENTS

| | | | |
|---|---|---|---|
| JP | 8-129329 | A | 5/1996 |
| JP | 11-133828 | A | 5/1999 |
| JP | 2002-169440 | A | 6/2002 |
| JP | 2003-202745 | A | 7/2003 |
| JP | 2006-195492 | A | 7/2006 |
| JP | 2007-065271 | A | 3/2007 |
| JP | 2008-216278 | A | 9/2008 |
| JP | 2009-075609 | A | 4/2009 |
| JP | 2010-049193 | A | 3/2010 |
| JP | 2012-073438 | A | 4/2012 |
| JP | 2016-224261 | A | 4/2012 |
| JP | 2014-025995 | A | 2/2014 |
| JP | 2014-048510 | A | 3/2014 |
| JP | 2015-102722 | A | 6/2015 |

OTHER PUBLICATIONS

Decision of Refusal issued in corresponding Japanese Patent Application No. 2018-129805 dated Jul. 19, 2022.

* cited by examiner

IMAGE FORMING APPARATUS

CROSS-REFERENCE TO RELATED APPLICATIONS

This application is a continuation of U.S. patent application Ser. No. 16/907,465, filed Jun. 22, 2020, now U.S. Pat. No. 11,144,004, which is a continuation of U.S. patent application Ser. No. 16/459,726, filed Jul. 2, 2019, now U.S. Pat. No. 10,725,423; which claims priority from Japanese Patent Application No. 2018-129805, filed on Jul. 9, 2018. The entire subject matter of the aforementioned applications are incorporated herein by reference.

TECHNICAL FIELD

The disclosure relates to an image forming apparatus.

BACKGROUND

There has been proposed an image forming apparatus includes an apparatus main body, a drawer configured to be movable between an inner position located inside the apparatus main body and an outer position located outside the apparatus main body, a plurality of cartridges supported to the drawer, and a waste toner box. Each of the plurality of cartridges includes a photosensitive drum, and a drum cleaning unit configured to remove waste toner from the photosensitive drum. The drawer includes a collective conveying unit configured to collect the waste toner from the plurality of drum cleaning units and to convey the same to the waste toner box.

SUMMARY

Illustrative aspects of the disclosure provide an image forming apparatus capable of securing smooth movement of a drawer while accommodating waste toner from a plurality of photosensitive drums into a waste toner box.

One illustrative aspect of the disclosure may provide an image forming apparatus comprising: an apparatus main body having an opening; a drawer movable between: an inner position where the drawer is located inside the apparatus main body; and an outer position where the drawer is located outside the apparatus main body through the opening; a first cartridge supported by the drawer, the first cartridge comprising: a first photosensitive drum; and a first discharge part configured to discharge waste toner removed from the first photosensitive drum; a second cartridge supported by the drawer, the second cartridge comprising: a second photosensitive drum; and a second discharge part configured to discharge waste toner removed from the second photosensitive drum; and a waste toner box comprising: a first coupling part configured to be coupled with the first discharge part; and a second coupling part configured to be coupled with the second discharge part, in a state where the first cartridge and the second cartridge are supported by the drawer located at the inner position and the waste toner box is mounted to the apparatus main body, the waste toner box being movable between: a first position where the first coupling part and the first discharge part are coupled and the second coupling part and the second discharge part are coupled; and a second position where the first coupling part and the first discharge part are decoupled and the second coupling part and the second discharge part are decoupled.

According to the disclosure, in a state where the waste toner box is located at the first position, the first coupling part can receive the waste toner from the first discharge part, and the second coupling part can receive the waste toner from the second discharge part.

For this reason, even though the drawer does not include a member configured to collect the waste toner from the first discharge part and the second discharge part and to convey the same to the waste toner box, it is possible to accommodate the waste toner from the first photosensitive drum and the second photosensitive drum into the waste toner box. Also, in a state where the waste toner box is located at the second position, the first coupling part and the first discharge part are decoupled and the second coupling part and the second discharge part are decoupled. As a result, it is possible to secure smooth movement of the drawer while accommodating the waste toner from the first photosensitive drum and the second photosensitive drum into the waste toner box.

According to the disclosure, it is possible to secure smooth movement of the drawer while accommodating the waste toner from the plurality of photosensitive drums.

BRIEF DESCRIPTION OF DRAWINGS

Illustrative aspects of the invention will be described in detail with reference to the following figures wherein.

DESCRIPTION OF EMBODIMENTS

Figure 1:
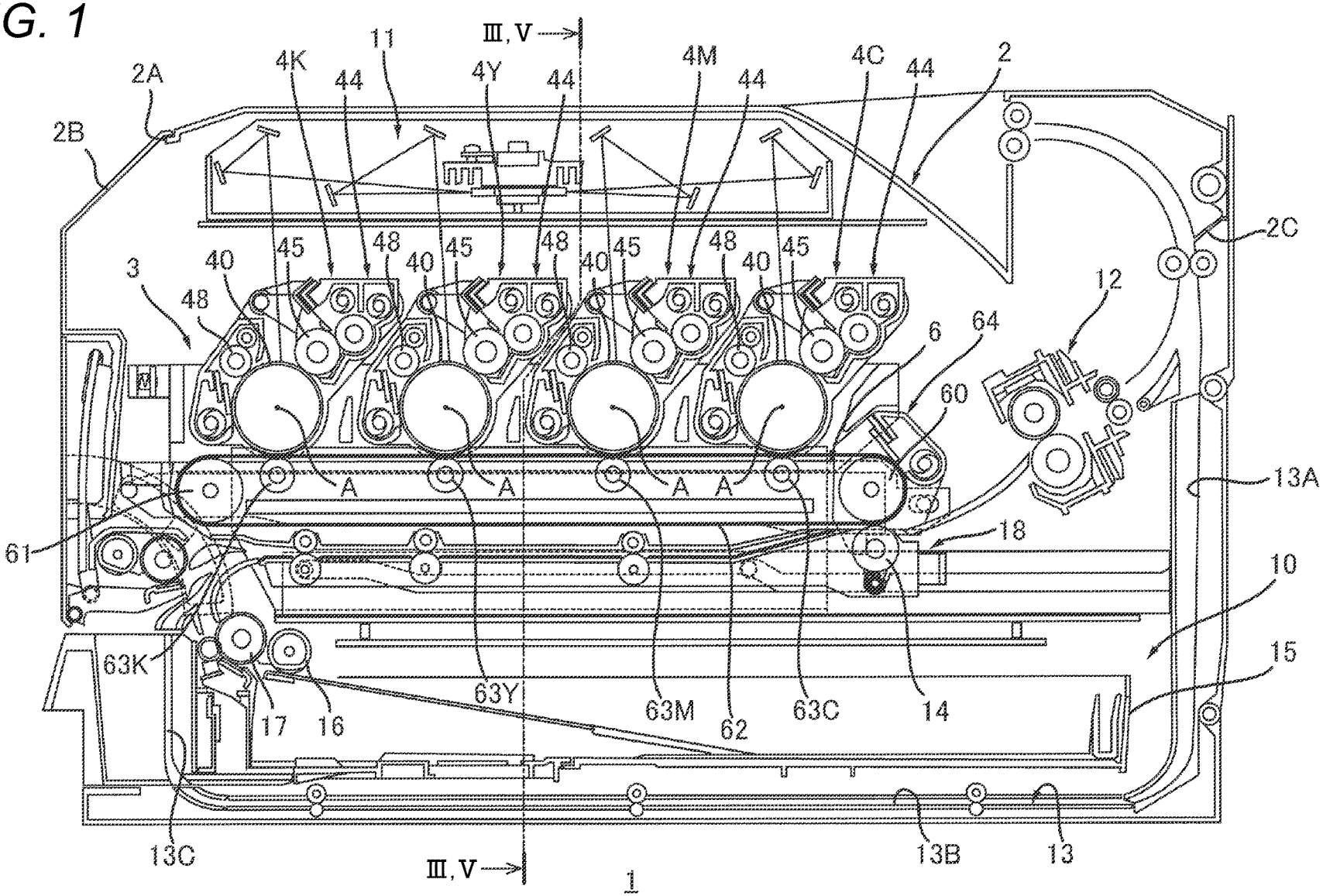
FIG. 1 is a schematic configuration view of an image forming apparatus.

In the related-art image forming apparatus, the collective conveying unit may be an obstacle to movement of the drawer.

Therefore, illustrative aspects of the disclosure provide an image forming apparatus capable of securing smooth movement of a drawer while accommodating waste toner from a plurality of photosensitive drums into a waste toner box.

1. Outline of Image Forming Apparatus 1

An outline of an image forming apparatus 1 is described with reference to FIG. 1.

The image forming apparatus 1 includes an apparatus main body 2, a feeder unit 10, a drawer 3, a plurality of cartridges 4K, 4Y, 4M, 4C, an exposure device 11, a belt unit (one example of a belt device) 6, a secondary transfer roller 14, a fixing device 12, and a duplex printing path 13.

1.1 Apparatus Main Body

The apparatus main body 2 is configured to accommodate therein the feeder unit 10, the drawer 3, the plurality of cartridges 4K, 4Y, 4M, 4C, the exposure device 11, the belt unit 6, the secondary transfer roller 14, the fixing device 12, and the duplex printing path 13. The apparatus main body 2 has an opening 2A and a cover 2B.

The opening 2A is located at an opposite side to the fixing device 12 with respect to the plurality of cartridges 4K, 4Y, 4M, 4C in a state where the drawer 3 is mounted to the apparatus main body 2.

The cover 2B is configured to be movable between a closing position (refer to FIG. 1) at which the opening 2A is closed and an opening position (refer to FIG. 2) at which the opening 2A is opened.

1.2 Feeder Unit

The feeder unit 10 is configured to feed a printing medium to the secondary transfer roller 14. The printing medium is a printing sheet, for example. The feeder unit 10 includes a sheet feeding tray 15, a pickup roller 16, and a feeder roller 17. The sheet feeding tray 15 is configured to accommodate therein the printing medium. The pickup roller 16 is configured to convey the printing medium in the sheet feeding tray 15 toward the feeder roller 17. The feeder roller 17 is configured to convey the printing medium from the pickup roller 16 toward the secondary transfer roller 14.

1.3 Drawer

Figure 2:
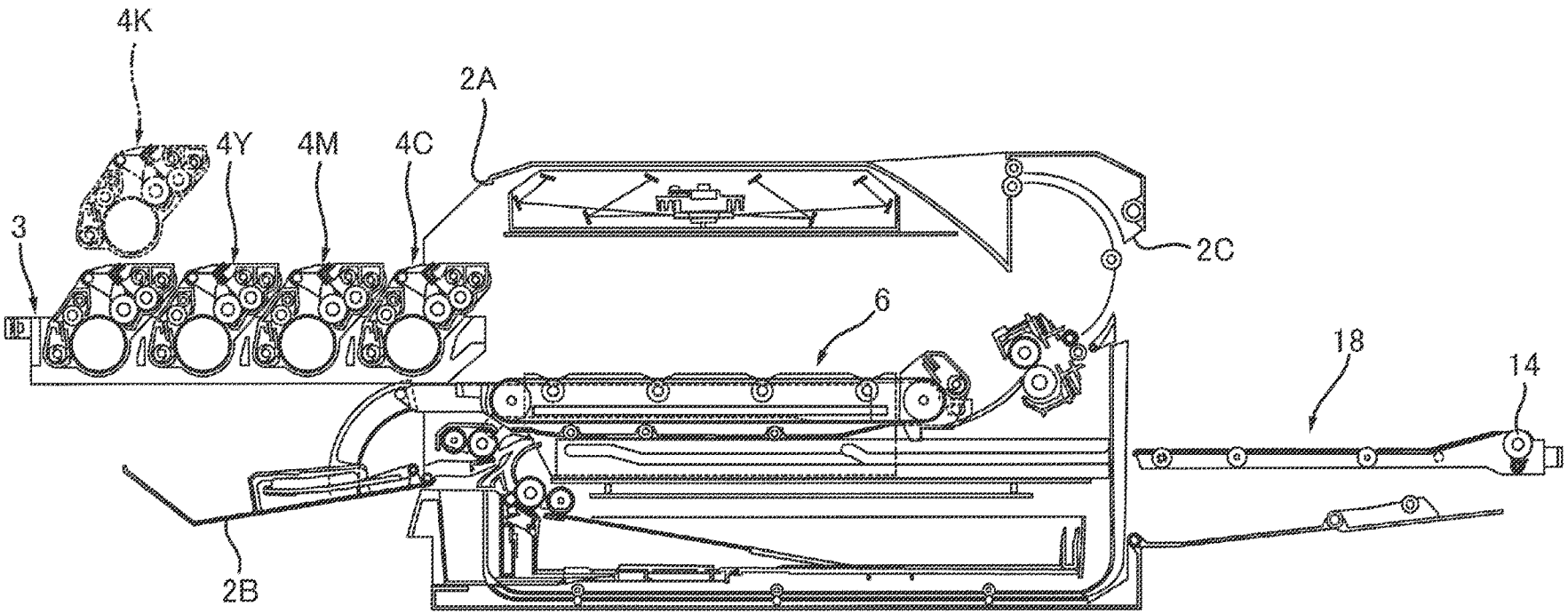
FIG. 2 depicts a state where a drawer shown in FIG. 1 is located at an outer position.

The drawer 3 is configured to be movable between an inner position located inside the apparatus main body 2 (refer to FIG. 1) and an outer position located outside the apparatus main body 2 (refer to FIG. 2) through the opening 2A, in a state where the cover 2B is located at the opening position (refer to FIG. 2). The drawer 3 is configured to support the plurality of cartridges 4K, 4Y, 4M, 4C. The drawer 3 is configured to be movable between the inner position and the outer position in an alignment direction (which will be described later), in a state where it supports the plurality of cartridges 4K, 4Y, 4M, 4C. In the meantime, the inner position is a position at which the drawer 3 is accommodated in the apparatus main body 2 and the plurality of cartridges 4K, 4Y, 4M, 4C cannot be mounted and demounted to and from the drawer 3. The outer position is a position at which at least a part of the drawer 3 is located outside the apparatus main body 2 and at least one of the plurality of cartridges 4K, 4Y, 4M, 4C can be mounted and demounted to and from the drawer 3. For this reason, even when a part of the drawer 3 is located inside the apparatus main body 2, if at least one of the plurality of cartridges 4K, 4Y, 4M, 4C can be mounted and demounted to and from the drawer 3, a position of the drawer 3 is included in the outer position.

1.4 Cartridge

The plurality of cartridges 4K, 4Y, 4M, 4C is supported to the drawer 3. The plurality of cartridges 4K, 4Y, 4M, 4C is aligned with intervals. A direction in which the plurality of cartridges 4K, 4Y, 4M, 4C is aligned is defined as 'alignment direction'. The alignment direction intersects with an axis direction. Preferably, the alignment direction is perpendicular to in the axis direction. The axis direction will be described later. Each of the plurality of cartridges 4K, 4Y, 4M, 4C includes a photosensitive drum 40, a charging roller 48, and a developing unit (one example of a developing device) 44.

The photosensitive drum 40 is configured to be rotatable about a rotational axis A. A direction in which the rotational axis A of the photosensitive drum 40 extends is defined as 'axis direction'. The axis direction intersects with both a vertical direction and the alignment direction. Preferably, the axis direction is perpendicular to both the vertical direction and the alignment direction. The photosensitive drum 40 extends in the axis direction, and has a cylindrical shape.

The charging roller 48 is configured to charge a peripheral surface of the photosensitive drum 40. The charging roller 48 is in contact with the peripheral surface of the photosensitive drum 40. In the meantime, the charging roller 48 may be replaced with a non-contact type charger such as a scorotron-type charger.

The developing unit 44 includes a developing roller 45. The developing unit 44 is arranged so that the developing roller 45 is to face the photosensitive drum 40. The developing roller 45 is configured to supply toner in the developing unit 44 to the photosensitive drum 40. The developing roller 45 is in contact with the photosensitive drum 40. The developing roller 45 is configured to develop a latent image formed on the photosensitive drum 40, thereby forming a toner image on the peripheral surface of the photosensitive drum 40.

1.5 Exposure Device

The exposure device 11 is configured to expose the photosensitive drum 40, thereby forming a latent image. The exposure device 11 is configured to expose the peripheral surface of the photosensitive drum 40 charged by the charging roller 48. Thereby, a latent image is formed on the peripheral surface of the photosensitive drum 40. The exposure device 11 is located above the drawer 3 in a state where the drawer 3 is located at the inner position. The exposure device 11 is, specifically, a laser scan unit.

1.6 Belt Unit

The belt unit 6 is arranged to face the photosensitive drums 40 of the plurality of cartridges 4K, 4Y, 4M, 4C in the state where the drawer 3 is located at the inner position. The belt unit 6 is located between the drawer 3 and the sheet feeding tray 15 in the state where the drawer 3 is located at the inner position. The belt unit 6 includes a first roller 60, a second roller 61, an intermediate transfer belt 62, a plurality of primary transfer rollers 63K, 63Y, 63M, 63C, and a belt cleaner 64.

The first roller 60 is configured to be rotatable about a rotational axis extending in the axis direction. The second roller 61 is located with being spaced from the first roller 60 in the alignment direction. The second roller 61 is located at an opposite side to the fixing device 12 with respect to the first roller 60 in the alignment direction. The second roller 61 is configured to be rotatable about a rotational axis extending in the axis direction.

The intermediate transfer belt 62 is supported by the first roller 60 and the second roller 61. The intermediate transfer belt 62 is an endless belt. The intermediate transfer belt 62 is wound around the first roller 60 and the second roller 61. The intermediate transfer belt 62 is configured to be movable around the first roller 60 and the second roller 61. The intermediate transfer belt 62 is in contact with the photosensitive drum 40, in the state where the drawer 3 is located at the inner position.

Each of the plurality of primary transfer rollers 63K, 63Y, 63M, 63C is configured to transfer the toner image from the photosensitive drum 40 to the intermediate transfer belt 62. The plurality of primary transfer rollers 63K, 63Y, 63M, 63C is located between the first roller 60 and the second roller 61. The plurality of primary transfer rollers 63K, 63Y, 63M, 63C is aligned in the alignment direction. The plurality of primary transfer rollers 63K, 63Y, 63M, 63C has the same structure, respectively. Each of the plurality of primary transfer rollers 63K, 63Y, 63M, 63C is located at an opposite side to the photosensitive drum 40 with respect to the intermediate transfer belt 62.

The belt cleaner 64 is configured to clean the intermediate transfer belt 62, thereby removing waste toner from a peripheral surface of the intermediate transfer belt 62. The belt cleaner 64 is located between the first roller 60 and the fixing device 12. The belt cleaner 64 is located at an opposite side to the first roller 60 with respect to the intermediate transfer belt 62.

1.7 Secondary Transfer Roller

The secondary transfer roller 14 is configured to transfer the toner image from the intermediate transfer belt 62 to the printing medium. The secondary transfer roller 14 is located at an opposite side to the first roller 60 with respect to the intermediate transfer belt 62. The intermediate transfer belt 62 passes between the secondary transfer roller 14 and the first roller 60 when it is moved. The secondary transfer roller 14 is provided for a secondary transfer unit 18.

The secondary transfer unit 18 is located between the belt unit 6 and the sheet feeding tray 15. The secondary transfer unit 18 can be demounted from the apparatus main body 2 through an opening 2C of the apparatus main body 2 (refer to FIG. 2). The opening 2C is located at an opposite side to the opening 2A with respect to the drawer 3 in the state where the drawer 3 is located at the inner position.

1.8 Fixing Device

The fixing device 12 is configured to heat and press the printing medium having the toner images transferred thereto, thereby fixing the toner images on the printing medium. The printing medium having passed through the fixing device 12 is discharged onto an upper surface of the apparatus main body 2.

1.9 Duplex Printing Path

The duplex printing path 13 is formed to again convey the printing medium having passed through the fixing device 12 toward the secondary transfer roller 14. The duplex printing path 13 includes a first path 13A, a second path 13B, and a third path 13C.

The first path 13A is located at an opposite side to the drawer 3 with respect to the fixing device 12 in the alignment direction, in the state where the drawer 3 is located at the inner position. The first path 13A extends in the vertical direction.

The second path 13B is a part between the first path 13A and the third path 13C of the duplex printing path 13. The second path 13B is located below the sheet feeding tray 15. The second path 13B extends in the alignment direction. The second path 13B has one end and the other end in the alignment direction. One end of the second path 13B continues to a lower end of the third path 13C. The other end of the second path 13B continues to a lower end of the first path 13A.

The third path 13C is located at an opposite side to the first path 13A with respect to the feeder roller 17 in the alignment direction. The third path 13C extends in the vertical direction. The third path 13C is supported to the sheet feeding tray 15.

2. Details of Cartridge

Subsequently, the plurality of cartridges 4K, 4Y, 4M, 4C is described in detail with reference to FIGS. 3, 4A and 4B. In the meantime, the plurality of cartridges 4K, 4Y, 4M, 4C has the same structure. Therefore, in the below, the cartridge 4M is described, and the descriptions of the cartridges 4K, 4Y, 4C are omitted.

Figure 3:
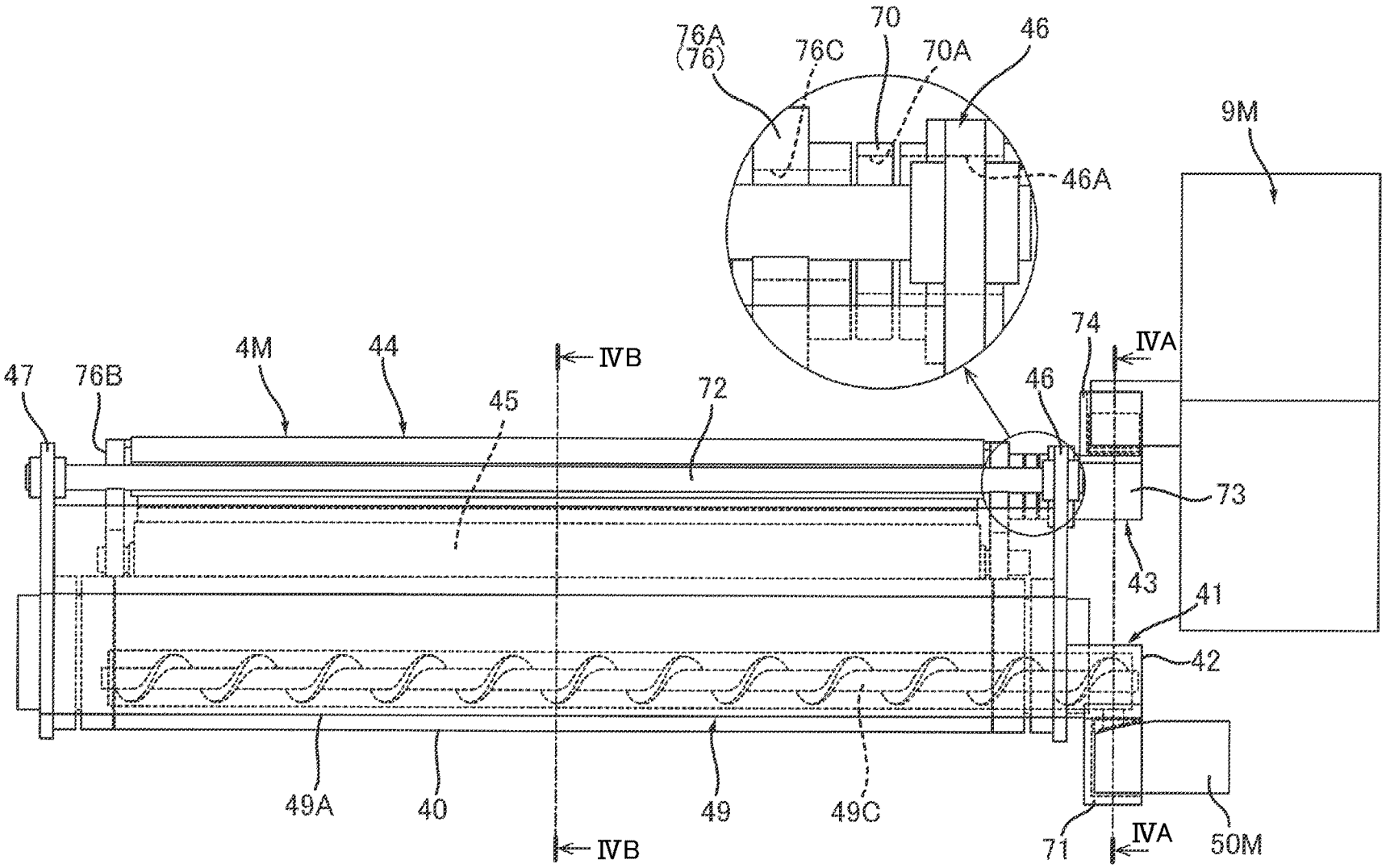
FIG. 3 is a sectional view taken along a line III-III of the image forming apparatus shown in FIG. 1, depicting a cartridge.

As shown in FIG. 3, each of the plurality of cartridges 4K, 4Y, 4M, 4C further has a frame 46, a frame 47, a shaft 72, an elastic member 70, a receiving part 43, a drum cleaner 49, and a discharge part 41.

2.1 Frame

The frame 46 is located at one end of the cartridge 4M in the axis direction. The frame 47 is located at the other end of the cartridge 4M in the axis direction. The frame 46 and the frame 47 are located with an interval in the axis direction. The frame 46 and the frame 47 extend in a direction intersecting with the axis direction, respectively. The frame 46 and the frame 47 are configured to rotatably support the photosensitive drum 40 and to swingably support the developing unit 44. The frame 46 is configured to rotatably support one end of the photosensitive drum 40 in the axis direction. The frame 47 is configured to rotatably support the other end of the photosensitive drum 40 in the axis direction. The frame 46 is arranged to face the developing unit 44 in the axis direction in which the rotational axis A of the photosensitive drum 40 extends. The frame 47 is located at an opposite side to the frame 46 with respect to the developing unit 44. The frame 46 and the frame 47 are configured to rotatably support the shaft 72. The frame 46 and the frame 47 are configured to support the developing unit 44 via the shaft 72.

2.2 Shaft

The shaft 72 is configured to support the developing unit 44 so that the developing roller 45 can move relative to the photosensitive drum 40. The shaft 72 is located above the photosensitive drum 40 in a state where the cartridge 4M is supported to the drawer 3. The shaft 72 extends in the axis direction. The shaft 72 has one end and the other end in the axis direction. One end of the shaft 72 is rotatably supported to the frame 46. The other end of the shaft 72 is rotatably supported to the frame 47.

2.3 Developing Frame

The developing unit 44 further includes a developing frame 76. The developing frame 76 is configured to support the developing roller 45. The developing frame 76 is mounted to the shaft 72. The developing frame 76 is located between the frame 46 and the frame 47 in the axis direction. The developing frame 76 extends in the axis direction. The developing frame 76 has one end 76A and the other end 76B in the axis direction. One end 76A of the developing frame 76 is arranged to face the frame 46 with an interval in the axis direction. The other end 76B of the developing frame 76 is located at an opposite side to the frame 46 with respect to one end 76A.

2.4 Elastic Member

The elastic member 70 is arranged between the developing unit 44 and the frame 46 in the axis direction. For this reason, it is possible to suppress the toner from being leaked from between the developing unit 44 and the frame 46 while securing smooth swing of the developing unit 44. The elastic member 70 is arranged between one end 76A of the developing frame 76 and the frame 46 in the axis direction. The elastic member 70 may be formed of rubber, sponge or the like, for example. The elastic member 70 has a through-opening 70A. The frame 46 has a first hole 46A. The elastic member 70 is fixed to the frame 46 so that the through-opening 70A is to communicate with the first hole 46A in the axis direction. Also, one end 76A of the developing frame 76 has a first communication hole 76C. The first communication hole 76C is formed to communicate with an internal space of the developing frame 76 and the through-opening 70A in the axis direction. That is, the first hole 46A, the through-opening 70A and the first communication hole 76C are formed to communicate with each other in the axis direction. Also, the first hole 46A is formed to communicate with an internal space of the toner receiving wall 73. For this reason, the internal space of the toner receiving wall 73 and the internal space of the developing frame 76 communicate with each other through the first hole 46A, the through-opening 70A and the first communication hole 76C. The toner receiving wall 73 will be described later.

2.5 Receiving Part

Figure 4B:
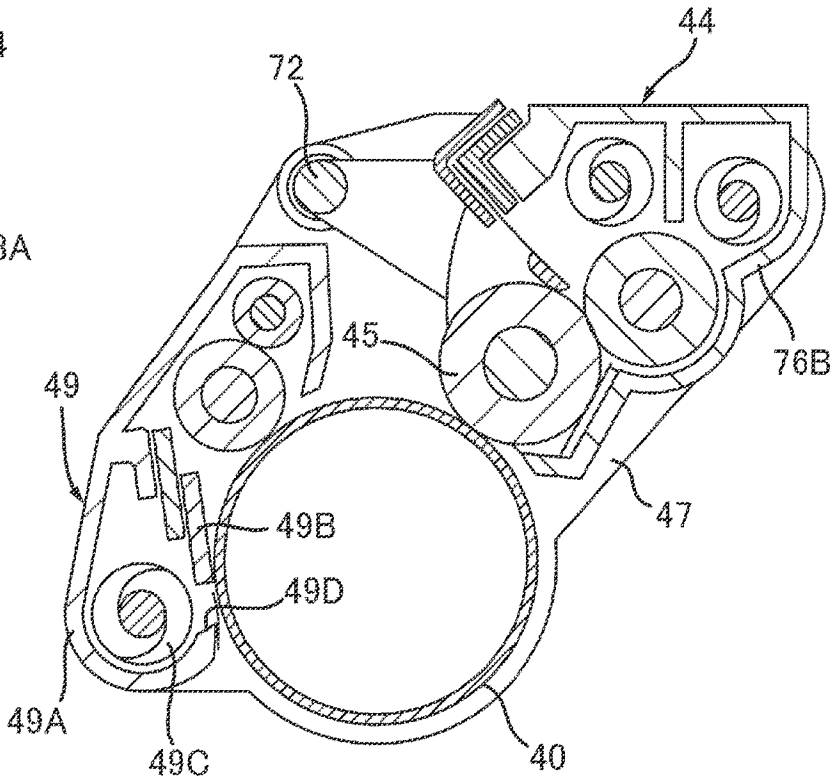
FIG. 4B is a sectional view taken along a line IVB-IVB of the cartridge shown in FIG. 3.
Figure 4A:
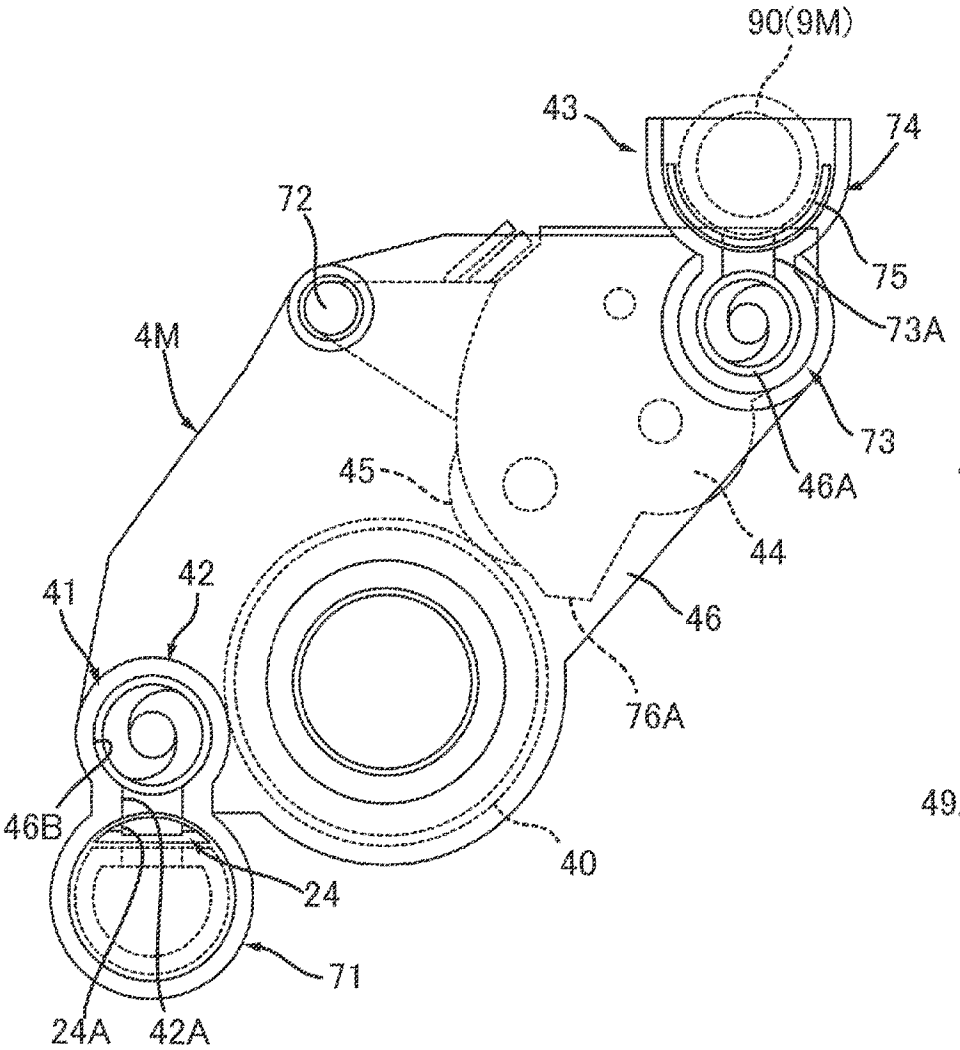
FIG. 4A is a sectional view taken along a line IVA-IVA of the cartridge shown in FIG. 3.

As shown in FIG. 4A, the receiving part 43 is configured to receive the toner from each of a plurality of toner boxes 9K, 9Y, 9M, 9C. In the meantime, the plurality of toner boxes 9K, 9Y, 9M, 9C will be described later. The receiving part 43 has a toner receiving wall 73, a toner coupling wall 74, and a shutter 75.

The toner receiving wall 73 is located at an opposite side to the developing unit 44 with respect to the frame 46. The toner receiving wall 73 has a cylindrical shape. The toner receiving wall 73 extends in the axis direction. The toner receiving wall 73 has one end and the other end in the axis direction. One end of the toner receiving wall 73 is closed (refer to FIG. 3). The other end of the toner receiving wall 73 is fixed to the frame 46 so that the internal space of the toner receiving wall 73 is to communicate with the first hole 46A. The toner receiving wall 73 has a toner receiving opening 73A. The toner is received into the toner receiving opening 73A. The toner receiving opening 73A is located at an upper end of the toner receiving wall 73 in the state where the cartridge 4M is supported to the drawer 3.

The toner coupling wall 74 is located above the toner receiving wall 73, in the state where the cartridge 4M is supported to the drawer 3. The toner coupling wall 74 has a semi-cylindrical shape. The toner coupling wall 74 is opened upward, in the state where the cartridge 4M is supported to the drawer 3. The toner coupling wall 74 extends in the axis direction. The toner coupling wall 74 has one end and the other end in the axis direction. One end of the toner coupling wall 74 is opened (refer to FIG. 3). The other end of the toner coupling wall 74 is closed. The toner coupling wall 74 is connected to the toner receiving wall 73 so that an internal space of the toner coupling wall 74 is to communicate with the toner receiving opening 73A. Thereby, the internal space of the toner coupling wall 74 communicates with the internal space of the toner receiving wall 73 through the toner receiving opening 73A.

The shutter 75 is arranged within the toner coupling wall 74. The shutter 75 has a semi-circular arc shape conforming to an inner peripheral surface of the toner coupling wall 74. The shutter 75 is configured to be movable between a closing position at which the toner receiving opening 73A is closed and an opening position at which the toner receiving opening 73A is opened.

2.6 Drum Cleaner

As shown in FIG. 4B, the drum cleaner 49 is located at an opposite side to the developing unit 44 with respect to the photosensitive drum 40. The drum cleaner 49 has a drum cleaner frame 49A, a drum cleaning blade 49B, and an auger 49C.

The drum cleaner frame 49A is configured to accommodate therein waste toner removed from the peripheral surface of the photosensitive drum 40 by the drum cleaning blade 49B. The drum cleaner frame 49A has an opening 49D for receiving the waste toner. The drum cleaner frame 49A is located between the frame 46 and the frame 47 in the axis direction. The drum cleaner frame 49A extends in the axis direction.

The drum cleaning blade 49B is configured to clean the photosensitive drum 40, thereby removing the waste toner from the peripheral surface of the photosensitive drum 40. An edge of the drum cleaning blade 49B is located in the opening 49D. The edge of the drum cleaning blade 49B is in contact with the peripheral surface of the photosensitive drum 40. Thereby, when the photosensitive drum 40 is rotated, the toner attached to the peripheral surface of the photosensitive drum 40 is scraped by the edge of the drum cleaning blade 49B and is then accommodated in the drum cleaner frame 49A through the opening 49D.

The auger 49C is configured to convey the waste toner in the drum cleaner frame 49A toward the discharge part 41. The auger 49C is located in the drum cleaner frame 49A. The auger 49C extends in the axis direction.

2.7 Discharge Part

As shown in FIG. 4A, the discharge part 41 is configured to discharge the waste toner removed from the photosensitive drum 40. The discharge part 41 has a discharge wall 42, a waste toner coupling wall 71, and an elastic member 24.

The discharge wall 42 is located at an opposite side to the drum cleaner frame 49A with respect to the frame 46 (refer to FIG. 3). The frame 46 has a second hole 46B. The second hole 46B is formed to communicate with an internal space of the drum cleaner frame 49A in the axis direction. The discharge wall 42 has a cylindrical shape. The discharge wall 42 extends in the axis direction. The discharge wall 42 has one end and the other end in the axis direction. One end of the discharge wall 42 is closed (refer to FIG. 3). The other end of the discharge wall 42 is fixed to the frame 46 so that an internal space of the discharge wall 42 is to communicate with the second hole 46B. Thereby, the internal space of the drum cleaner frame 49A and the internal space of the discharge wall 42 communicate with each other through the second hole 46B, in the axis direction. The discharge wall 42 has a discharge opening 42A. The waste toner is to pass through the discharge opening 42A. The discharge opening 42A is located at a lower end of the discharge wall 42, in the state where the cartridge 4M is supported to the drawer 3.

The waste toner coupling wall 71 is located below the discharge wall 42 in the state where the cartridge 4M is supported to the drawer 3. The waste toner coupling wall 71 extends in the axis direction. The waste toner coupling wall 71 has one end and the other end in the axis direction. One end of the waste toner coupling wall 71 is opened. The other end of the waste toner coupling wall 71 is closed (refer to FIG. 3). The waste toner coupling wall 71 is connected to the discharge wall 42 so that an internal space of the waste toner coupling wall 71 is to communicate with the discharge opening 42A. Thereby, the internal space of the waste toner coupling wall 71 communicates with the internal space of the discharge wall 42, through the discharge opening 42A.

The elastic member 24 is located within the waste toner coupling wall 71. The elastic member 24 has a communication opening 24A. The elastic member 24 is fixed to an inner peripheral surface of the waste toner coupling wall 71 so that the communication opening 24A is to communicate with the discharge opening 42A. The elastic member 24 may be formed of rubber, sponge or the like, for example.

3. Details of Image Forming Apparatus

Figure 5:
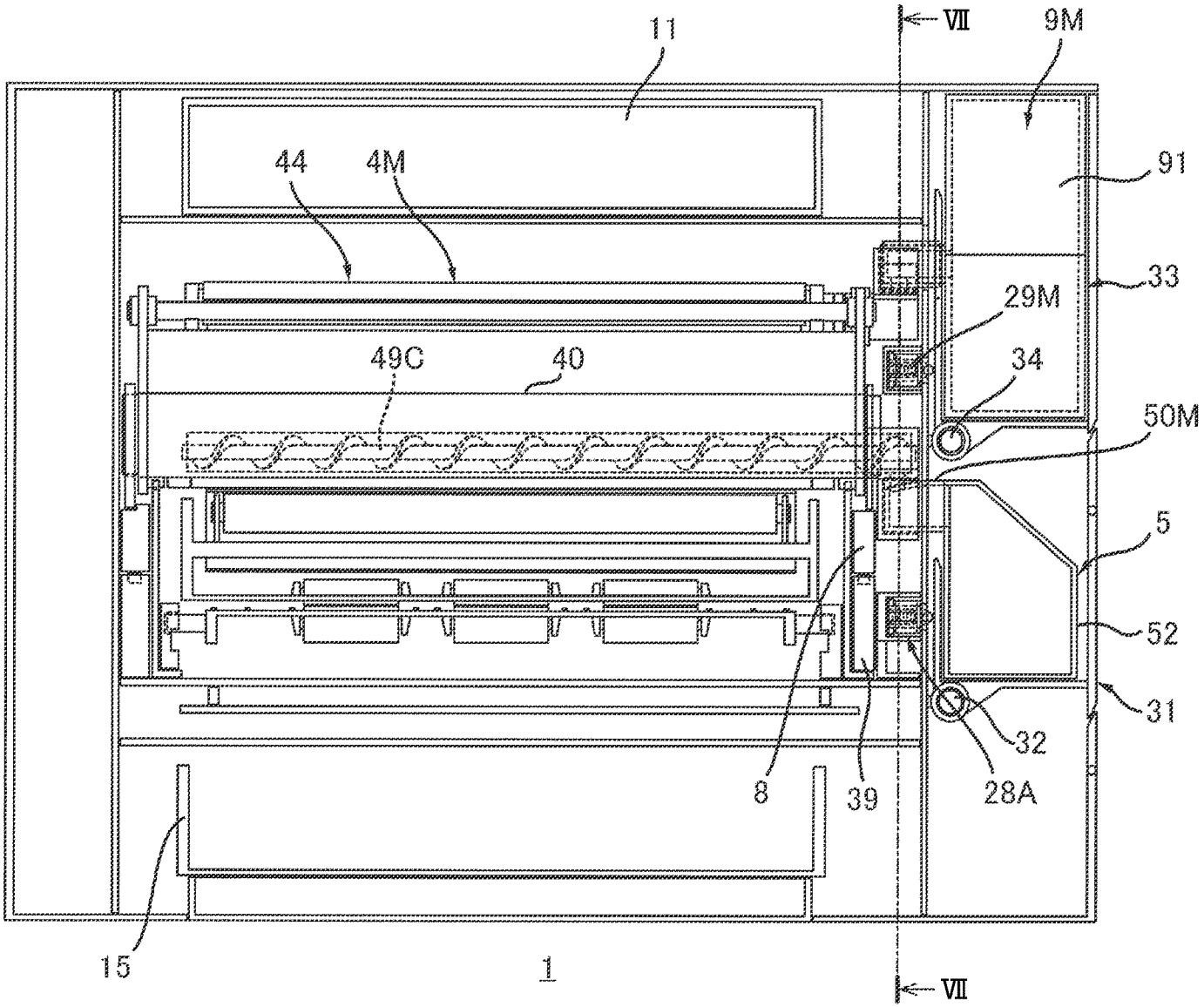
FIG. 5 is a sectional view taken along a line V-V of the image forming apparatus shown in FIG. 1.
Figure 7:
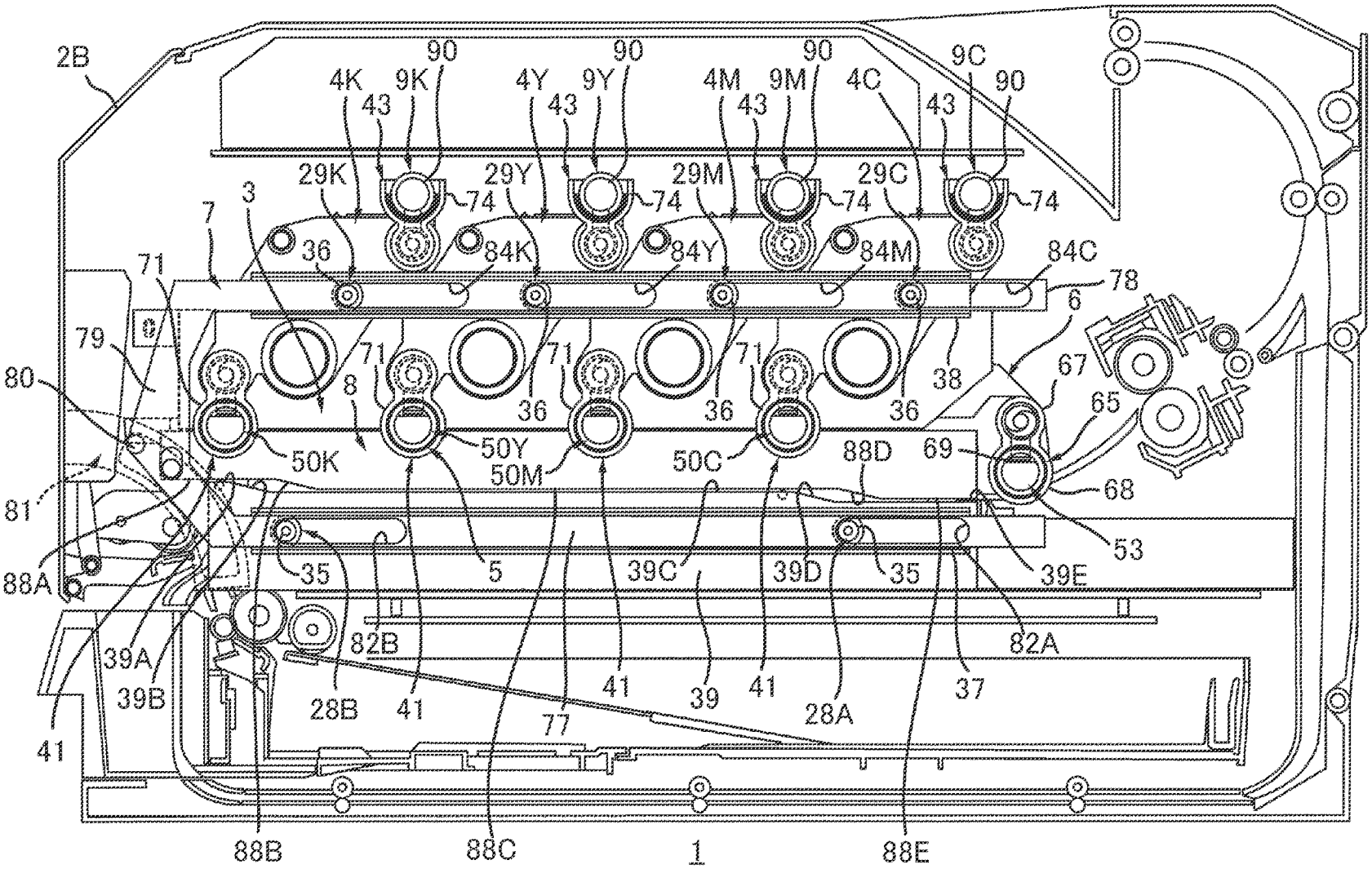
FIG. 7 is a sectional view taken along a line D-D of the image forming apparatus shown in FIG. 1.

As shown in FIG. 5, the image forming apparatus 1 further includes a waste toner box 5, and a plurality of toner boxes 9K, 9Y, 9M, 9C (refer to FIG. 7).

3.1 Waste Toner Box

Figure 6:
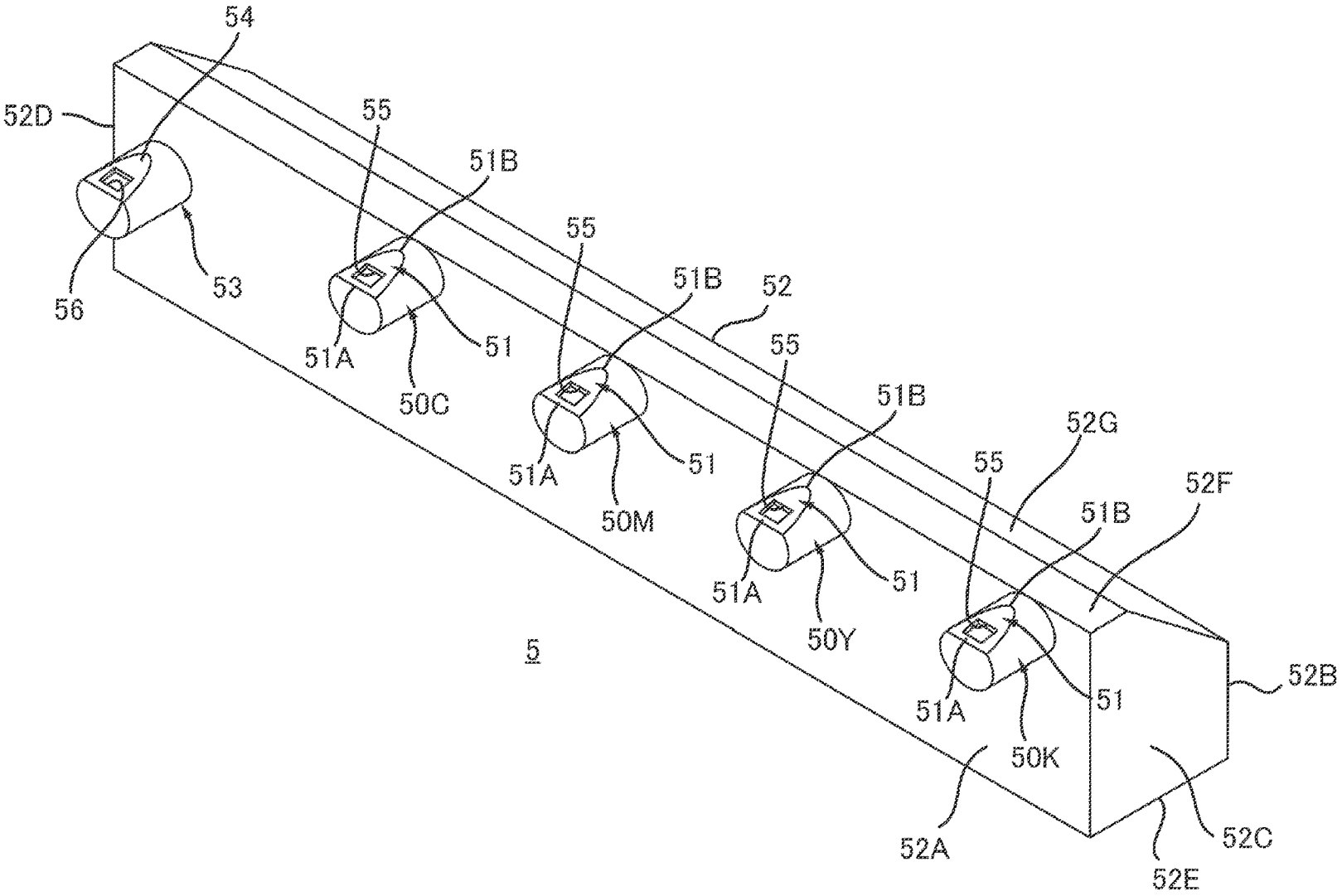
FIG. 6 is a perspective view of a waste toner box shown in FIG. 5.

As shown in FIG. 6, the waste toner box 5 has a box main body 52, a plurality of coupling parts 50K, 50Y, 50M, 50C, and a sub-coupling part 53.

3.1.1 Box Main Body

The box main body 52 can accommodate therein the waste toner removed from the photosensitive drum 40 and the waste toner removed from the intermediate transfer belt 62 (refer to FIG. 1). The box main body 52 extends in the alignment direction. The box main body 52 has a first wall 52A, a second wall 52B, a first sidewall 52C, a second sidewall 52D, a bottom wall 52E, an upper wall 52F, and an inclined wall 52G. In the meantime, the configuration of the box main body 52 is described on the basis of a state where the waste toner box 5 is located at a first position, which will be described later.

The first wall 52A is configured to support the plurality of coupling parts 50K, 50Y, 50M, 50C. The second wall 52B is located at an opposite side to the plurality of coupling parts 50K, 50Y, 50M, 50C with respect to the first wall 52A. The second wall 52B is located with being spaced from the first wall 52A in the axis direction.

The first sidewall 52C and the second sidewall 52D are located at both end portions of the box main body 52 in the alignment direction, and are spaced from each other in the alignment direction. The bottom wall 52E is located at a lower end portion of the box main body 52.

The upper wall 52F is arranged with being spaced from the bottom wall 52E in the vertical direction, and extends in parallel with the bottom wall 52E. The upper wall 52F has one end and the other end in the axis direction. One end of the upper wall 52F in the axis direction is located with being spaced from an upper end of the second wall 52B. One end of the upper wall 52F in the axis direction is located above the upper end of the second wall 52B. The other end of the upper wall 52F in the axis direction is connected to an upper end of the first wall 52A.

The inclined wall 52G is formed to interconnect one end of the upper wall 52F in the axis direction and the upper end of the second wall 52B. The inclined wall 52G intersects with both the vertical direction and the axis direction. The inclined wall 52G is inclined toward the bottom wall 52E from the upper wall 52F toward the second wall 52B. Since the inclined wall 52G is inclined, when mounting and demounting the plurality of toner boxes 9K, 9Y, 9M, 9C to and from the apparatus main body 2, it is possible to suppress the waste toner box 5 from being an obstacle (refer to FIG. 10B).

3.1.2 Coupling Part

The plurality of coupling parts 50K, 50Y, 50M, 50C can be coupled with the discharge parts 41 of the plurality of cartridges 4K, 4Y, 4M, 4C (refer to FIG. 7). Specifically, the coupling part 50K can be coupled with the discharge part 41 of the cartridge 4K. The coupling part 50Y can be coupled with the discharge part 41 of the cartridge 4Y. The coupling part 50M can be coupled with the discharge part 41 of the cartridge 4M. The coupling part 50C can be coupled with the discharge part 41 of the cartridge 4C.

The plurality of coupling parts 50K, 50Y, 50M, 50C is located on an outer surface of the box main body 52 in the axis direction. The plurality of coupling parts 50K, 50Y, 50M, 50C protrudes from the first wall 52A. The plurality of coupling parts 50K, 50Y, 50M, 50C is arranged with intervals in the alignment direction. The plurality of coupling parts 50K, 50Y, 50M, 50C has the same structure, respectively. Therefore, the coupling part 50M is described, and the descriptions of the coupling parts 50K, 50Y, 50C are omitted.

The coupling part 50M has a cylindrical shape. The coupling part 50M extends in the axis direction. The coupling part 50M has one end and the other end in the axis direction. One end of the coupling part 50M is fixed to the box main body 52. The other end of the coupling part 50M is closed. An internal space of the coupling part 50M is formed to communicate with an internal space of the box main body 52. The coupling part 50M has a receiving wall 51. That is, the plurality of coupling parts 50K, 50Y, 50M, 50C has a receiving wall 51, respectively. The receiving wall 51 is located at an upper end of the coupling part 50M in the state where the waste toner box 5 is located at a first position. The first position of the waste toner box 5 will be described later. The receiving wall 51 has a receiving opening 55. The waste toner from the discharge opening 42A is received through the receiving opening 55.

3.1.3 Sub-Coupling Part

The sub-coupling part 53 is located on an outer surface of the box main body 52 in the axis direction. The sub-coupling part 53 protrudes from the first wall 52A. The sub-coupling part 53 is arranged with being spaced from the coupling part 50C in the alignment direction. The sub-coupling part 53 has the same structure as the coupling part 50M. Therefore, the detailed description of the sub-coupling part 53 is omitted. In the meantime, a receiving wall of the sub-coupling part 53 is described as a receiving wall 54, and a receiving opening of the sub-coupling part 53 is described as a receiving opening 56.

Also, as shown in FIG. 7, the sub-coupling part 53 can be coupled with a sub-discharge part 65 of the belt unit 6. The sub-discharge part 65 is configured to discharge the waste toner removed from the intermediate transfer belt 62 (refer to FIG. 1) by the belt cleaner 64 (refer to FIG. 1). The sub-discharge part 65 has the same configuration as the discharge part 41. Therefore, the detailed description of the sub-discharge part 65 is omitted. In the meantime, a discharge wall of the sub-discharge part 65 is described as a discharge wall 67, a waste toner coupling wall of the sub-discharge part 65 is described as a waste toner coupling wall 68, and an elastic member of the sub-discharge part 65 is described as an elastic member 69.

3.1.4 First Position of Waste Toner Box

The waste toner box 5 is configured to be movable between a first position (refer to FIG. 8) and a second position (refer to FIG. 9) in a state where the waste toner box is mounted to the apparatus main body 2. In the exemplary embodiment, the waste toner box 5 is configured to be rotatable among the first position (refer to FIG. 8), the second position (refer to FIG. 9), and a third position (refer to FIG. 10A) in the state where the waste toner box is mounted to the apparatus main body 2. For this reason, it is possible to smoothly move the waste toner box 5 to the first position, the second position and the third position.

Figure 8:
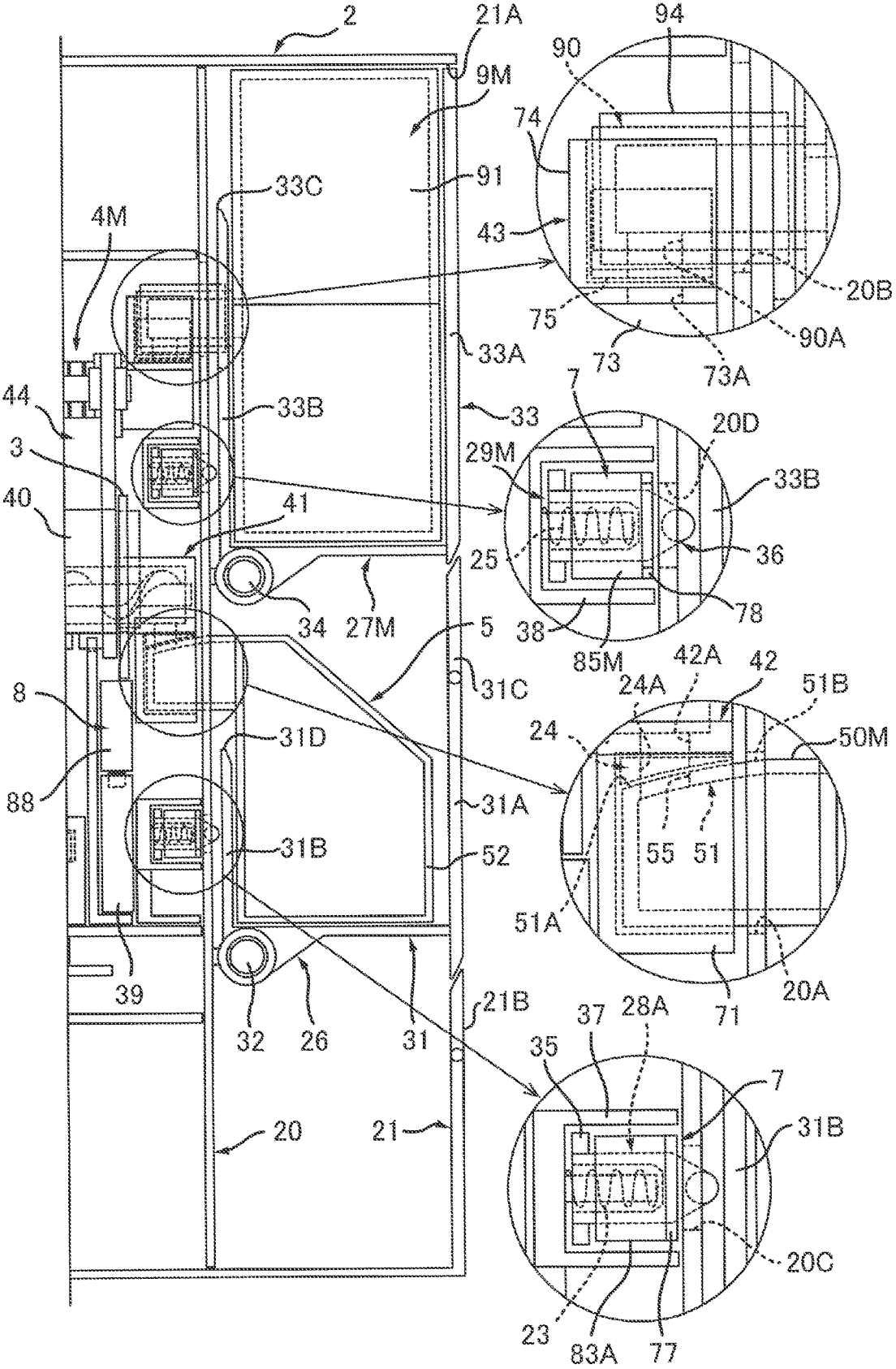
FIG. 8 is an enlarged view of the image forming apparatus shown in FIG. 5, depicting a state where the waste toner box is located at a first position and a toner box is located at a coupling position.

As shown in FIG. 8, in a state where the plurality of cartridges 4K, 4Y, 4M, 4C is supported to the drawer 3 located at the inner position and the waste toner box 5 is located at the first position, the waste toner box 5 is arranged in alignment with the plurality of cartridges 4K, 4Y, 4M, 4C in the axis direction in which the rotational axis A of the photosensitive drum 40 extends (refer to FIG. 1). In the state where the plurality of cartridges 4K, 4Y, 4M, 4C is supported to the drawer 3 located at the inner position and the waste toner box 5 is located at the first position, the plurality of coupling parts 50K, 50Y, 50M, 50C and the discharge parts 41 of the plurality of cartridges 4K, 4Y, 4M, 4C are coupled with each other (refer to FIG. 7). Specifically, the coupling part 50K is coupled with the discharge part 41 of the cartridge 4K, the coupling part 50Y is coupled with the discharge part 41 of the cartridge 4Y, the coupling part 50M is coupled with the discharge part 41 of the cartridge 4M, and the coupling part 50C is coupled with the discharge part 41 of the cartridge 4C. More specifically, each of the plurality of coupling parts 50K, 50Y, 50M, 50C is fitted to the waste toner coupling wall 71 (refer to FIG. 7). The receiving wall 51 faces the discharge wall 42 in the state where the waste toner box 5 is located at the first position. The receiving wall 51 has a first end portion 51A and a second end portion 51B in a direction facing from the waste toner box 5 toward the plurality of cartridges 4K, 4Y, 4M, 4C. The second end portions 51B are located at an opposite side to the plurality of cartridges 4K, 4Y, 4M, 4C with respect to the first end portions 51A, in the state where the waste toner box 5 is located at the first position. The receiving wall 51 is inclined so as to be distant from the discharge wall 42 from the second end portion 51B toward the first end portion 51A in the state where the waste toner box 5 is located at the first position. For this reason, when the waste toner box 5 is moved from the second position (refer to FIG. 9) to the first position, it is possible to suppress the receiving wall 51 from contacting the discharge wall 42 and to stably arrange the receiving wall 51 so as to face the discharge wall 42.

Also, the elastic member 24 is arranged between the discharge wall 42 and the receiving wall 51 in the state where the waste toner box 5 is located at the first position. The communication opening 24A communicates with each of the discharge opening 42A and the receiving opening 55. For this reason, in the state where the waste toner box 5 is located at the first position, the elastic member 24 can stably fill a gap between the discharge wall 42 and the receiving wall 51. The waste toner that is discharged from the discharge opening 42A is received into the receiving opening 55 through the communication opening 24A. As a result, it is possible to prevent the waste toner from being leaked from between the discharge wall 42 and the receiving wall 51.

Also, the sub-coupling part 53 is fitted to the waste toner coupling wall 68 in the state where the waste toner box 5 is located at the first position (refer to FIG. 7).

3.1.5 Second Position of Waste Toner Box

Figure 9:
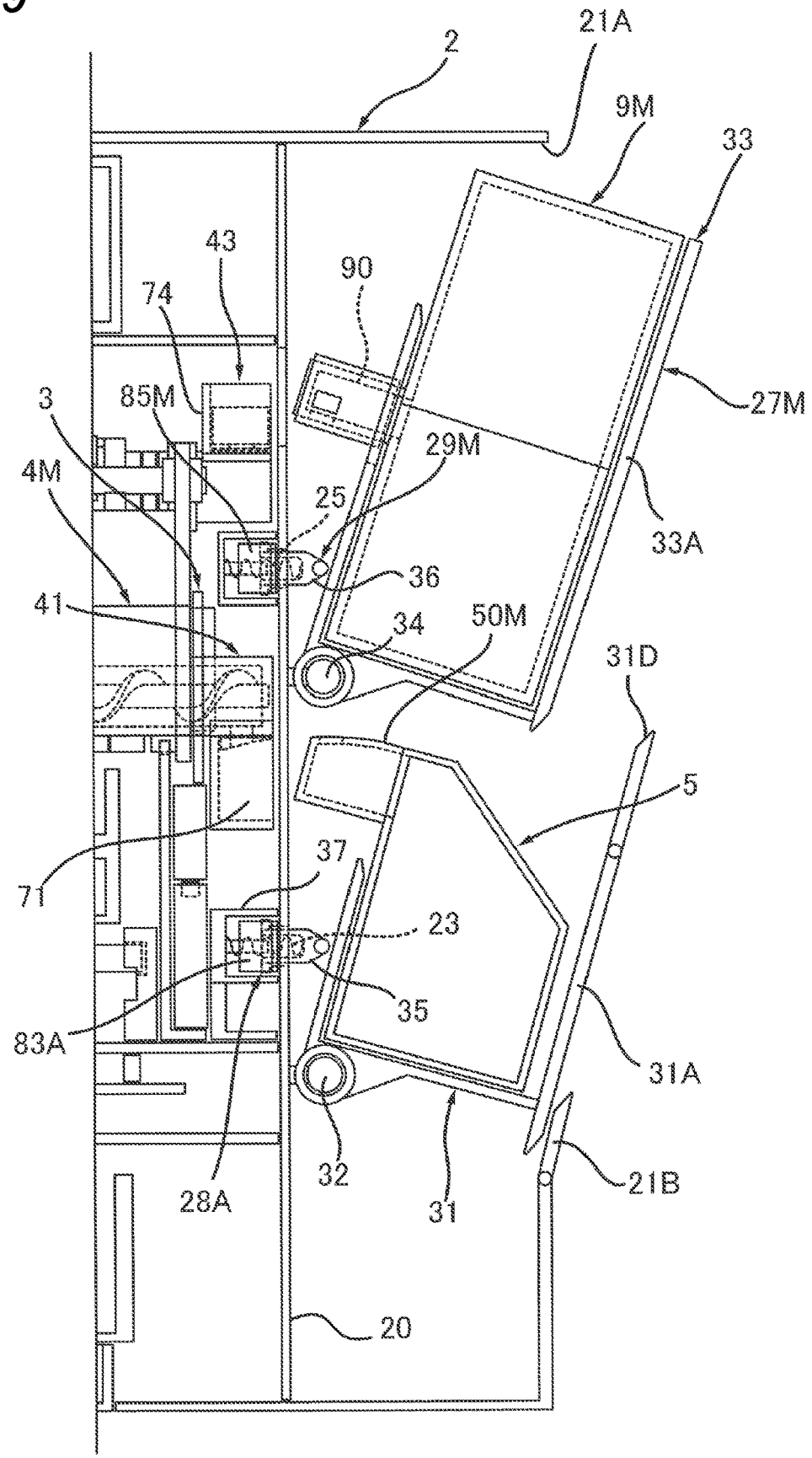
FIG. 9 depicts a state where the waste toner box shown in FIG. 8 is located at a second position and the toner box is located at a decoupling position.

As shown in FIG. 9, in a state where the plurality of cartridges 4K, 4Y, 4M, 4C is supported to the drawer 3 located at the inner position and the waste toner box 5 is located at the second position, the waste toner box 5 is located more distant from the plurality of cartridges 4K, 4Y, 4M, 4C, as compared to the case where the waste toner box 5 is located at the first position (refer to FIG. 1). Specifically, in a state where the waste toner box 5 is accommodated in a first accommodation frame 31 (which will be described later), the waste toner box is rotated about a rotary shaft 32 (which will be described later), which is a support point, and is tilted so as to be distant from the first wall 20. In the state where the plurality of cartridges 4K, 4Y, 4M, 4C is supported to the drawer 3 located at the inner position and the waste toner box 5 is located at the second position, the plurality of coupling parts 50K, 50Y, 50M, 50C and the discharge parts 41 of the plurality of cartridges 4K, 4Y, 4M, 4C are decoupled. Specifically, the coupling part 50K and the discharge part 41 of the cartridge 4K are decoupled, the coupling part 50Y and the discharge part 41 of the cartridge 4Y are decoupled, the coupling part 50M and the discharge part 41 of the cartridge 4M are decoupled, and the coupling part 50C and the discharge part 41 of the cartridge 4C are decoupled. More specifically, each of the plurality of coupling parts 50K, 50Y, 50M, 50C is separated from the waste toner coupling wall 71, and is located with being spaced from each of the discharge parts 41 of the plurality of cartridges 4K, 4Y, 4M, 4C in the axis direction.

In the meantime, in the state where the waste toner box 5 is located at the second position, the plurality of toner boxes 9K, 9Y, 9M, 9C mounted to the apparatus main body 2 is located downstream of the waste toner box 5 located at the second position with respect to a separation direction of the waste toner box 5 from the apparatus main body 2. For this reason, in the state where the waste toner box 5 is located at the second position, the waste toner box 5 cannot be separated from the apparatus main body 2.

3.1.6 Third Position of Waste Toner Box

Figure 10B:
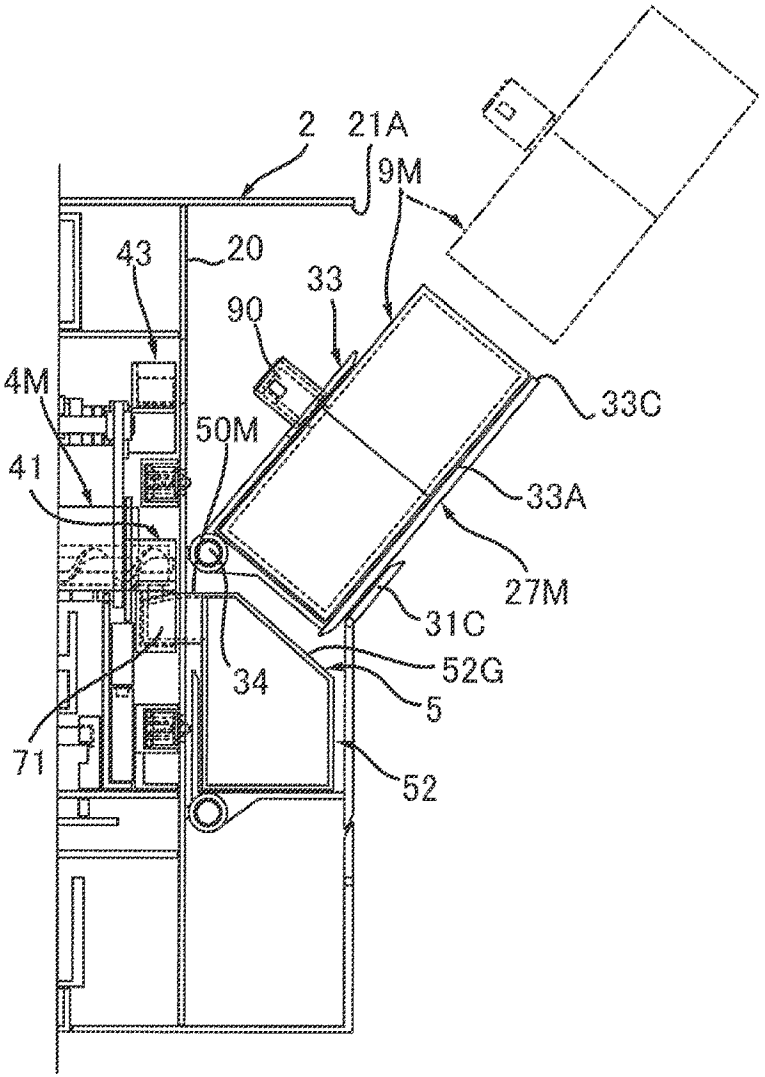
FIG. 10B depicts a state where the waste toner box shown in FIG. 9 is located at the first position and the toner box is located at a separable position.
Figure 10A:
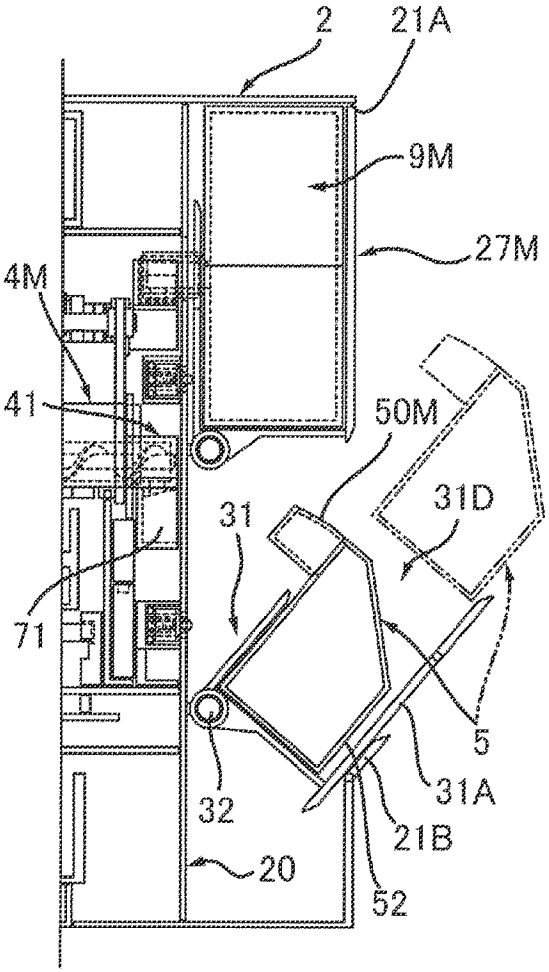
FIG. 10A depicts a state where the waste toner box shown in FIG. 9 is located at a third position and the toner box is located at the coupling position.

As shown in FIG. 10A, in a state where the waste toner box 5 is located at the third position, the waste toner box 5 is located more distant from the first position than the second position. In the state where the waste toner box 5 is located at the third position, a distance between each of the plurality of coupling parts 50K, 50Y, 50M, 50C and each of the plurality of discharge part 41 is greater than a distance in the state where the waste toner box 5 is located at the second position. Specifically, when the waste toner box 5 is moved from the second position to the third position, a first accommodation frame 31 (which will be described later) configured to support the waste toner box 5 is rotated about a rotary shaft 32 (which will be described later), which is a support point, and is tilted so as to be distant from the first wall 20.

Thereby, in the state where the waste toner box 5 is located at the third position, the plurality of toner boxes 9K, 9Y, 9M, 9C mounted to the apparatus main body 2 is not located downstream of the waste toner box 5 located at the third position with respect to the separation direction of the waste toner box 5 from the apparatus main body 2. For this reason, in the state where the waste toner box 5 is located at the third position, the waste toner box 5 can be separated from the apparatus main body 2.

3.2 Support Configuration of Waste Toner Box

As shown in FIG. 8, the apparatus main body 2 is configured to support the waste toner box 5 so that the waste toner box 5 can move. Specifically, the apparatus main body 2 further includes a first wall 20, a second wall 21, and a first support part 26.

3.2.1 First Wall

The first wall 20 is formed to divide an internal space of the apparatus main body 2 into a first space in which the plurality of cartridges 4K, 4Y, 4M, 4C (refer to FIG. 1) is accommodated and a second space in which the waste toner box 5 and the plurality of toner boxes 9K, 9Y, 9M, 9C (refer to FIG. 8) are accommodated. The first wall 20 extends in the vertical direction. The first wall 20 is located between the plurality of cartridges 4K, 4Y, 4M, 4C and the waste toner box 5 located at the first position. Specifically, the first wall 20 is located between the plurality of cartridges 4K, 4Y, 4M, 4C and the box main body 52 of the waste toner box 5 located at the first position, in the axis direction. The first wall 20 has a plurality of first hole 20A. Each of the plurality of first hole 20A is formed to face the waste toner coupling wall 71 in the axis direction, in the state where the drawer 3 is located at the inner position. The plurality of first hole 20A is formed to receive the plurality of coupling parts 50K, 50Y, 50M, 50C (refer to FIG. 6), in the state where the waste toner box 5 is located at the first position.

3.2.2 Second Wall

The second wall 21 is located at an opposite side to the plurality of cartridges 4K, 4Y, 4M, 4C with respect to the waste toner box 5 located at the first position. The second wall 21 is located with being spaced from the first wall 20 in the axis direction. The second wall 21 extends in the vertical direction. The second wall 21 has a second opening 21A and a movable wall 21B.

The second opening 21A is located at an opposite side to the plurality of cartridges 4K, 4Y, 4M, 4C with respect to the waste toner box 5 located at the first position, in the axis direction.

The movable wall 21B is configured to be movable in association with movement of the waste toner box 5. For this reason, it is possible to suppress the second wall 21 from being an obstacle to movement of the waste toner box 5, so that it is possible to secure smooth movement of the waste toner box 5. The movable wall 21B is supported to a lower end of the second opening 21A of the second wall 21. The movable wall 21B can swing about a lower end portion of the movable wall 21B, which is a support point. The movable wall 21B extends in the vertical direction, in the state where the waste toner box 5 is located at the first position.

3.2.3 First Accommodation Part

The first support part 26 is configured to support the waste toner box 5. The first support part 26 is located between the first wall 20 and the second wall 21 in the axis direction. The first support part 26 is supported to the first wall 20. The first support part 26 has a rotary shaft 32 and a first accommodation frame 31.

The rotary shaft 32 extends in the alignment direction. The rotary shaft 32 is rotatably supported to the first wall 20.

The first accommodation frame 31 can accommodate therein the waste toner box 5. The first accommodation frame 31 has a first side frame 31A, a second side frame 31B, a movable frame 31C, and a mounting/demounting opening 31D.

The first side frame 31A is located at one end of the first accommodation frame 31 in the axis direction. The second side frame 31B is located at the other end of the first accommodation frame 31 in the axis direction. The first side frame 31A is located at an opposite side to the first wall 20 with respect to the box main body 52, in the state where the waste toner box 5 is located at the first position. The second side frame 31B is located between the box main body 52 and the first wall 20 in the state where the waste toner box 5 is located at the first position. Each of the first side frame 31A and the second side frame 31B extends in the vertical direction, in the state where the waste toner box 5 is located at the first position.

The movable frame 31C is configured to be movable in association with movement of the plurality of toner boxes 9K, 9Y, 9M, 9C. The movable frame 31C is supported to an upper end of the first side frame 31A. The movable frame 31C extends in the vertical direction in a state where the waste toner box 5 is located at the first position and the plurality of toner boxes 9K, 9Y, 9M, 9C is located at a coupling position. In the meantime, the coupling position will be described later. The movable frame 31C is configured to be swingable about a lower end portion of the movable frame 31C, which is a support point. The first side frame 31A and the movable frame 31C are configured to close a lower part of the second opening 21A, in the state where the waste toner box 5 is located at the first position.

The mounting/demounting opening 31D is formed to allow the waste toner box 5 to pass therethrough when mounting and demounting the waste toner box 5 to and from the first accommodation frame 31. The mounting/demounting opening 31D is defined between an upper end of the second side frame 31B and an upper end of the movable frame 31C.

The first accommodation frame 31 is mounted to the rotary shaft 32. Specifically, a lower end portion of the first accommodation frame 31 is fixed to the rotary shaft 32. Thereby, the waste toner box 5 rotates about the rotary shaft 32 in a state where it is accommodated in the first support part 26. That is, a rotation support point of the waste toner box 5 is the rotary shaft 32 and is supported to the first wall 20. For this reason, as compared to a configuration where the rotation support point of the waste toner box 5 is supported to the second wall 21, it is possible to reduce an amount of movement of the coupling part 50M in the vertical direction and to make the image forming apparatus 1 smaller in the vertical direction.

As shown in FIG. 9, when the waste toner box 5 is moved from the first position to the second position, the first accommodation frame 31 is tilted so as to be distant from the first wall 20 about the rotary shaft 32, which is a support point. In the state where the waste toner box 5 is located at the second position, the plurality of coupling parts 50K, 50Y, 50M, 50C (refer to FIG. 6) is located at an opposite side to the discharge part 41 with respect to the first wall 20. Also, in the state where the waste toner box 5 is located at the second position, the waste toner box 5 cannot be separated from the first accommodation frame 31. In the state where the waste toner box 5 is located at the second position, the waste toner box 5 overlaps the second support part 27M in the separation direction from the apparatus main body 2, specifically, in the extension direction of the first side frame 31A. In the meantime, the second support part 27M will be described later.

As shown in FIG. 10A, when the waste toner box 5 is moved from the second position to the third position, the first accommodation frame 31 is tilted so as to be more distant from the first wall 20 than at the second position about the rotary shaft 32, which is a support point. In the state where the waste toner box 5 is located at the third position, the waste toner box 5 does not overlap the second support part 27M in the separation direction from the apparatus main body 2, specifically, in the extension direction of the first side frame 31A. Also, the mounting/demounting opening 31D is exposed from the lower part of the second opening 21A. For this reason, the waste toner box 5 can be separated from the first accommodation frame 31 through the mounting/demounting opening 31D and the second opening 21A.

Also, when the waste toner box 5 is moved from the first position (refer to FIG. 8) to the second position (refer to FIG. 9) or to the third position (refer to FIG. 10A), the first side frame 31A comes in contact with the movable wall 21B. For this reason, the movable wall 21B swings so as to be distant from the first wall 20 about a lower end of the movable wall 21B, which is a support point, in association with movement of the first accommodation frame 31.

3.3 Toner Box

As shown in FIG. 8, the plurality of toner boxes 9K, 9Y, 9M, 9C is configured to supply the toner to the plurality of cartridges 4K, 4Y, 4M, 4C (refer to FIG. 7). Each of the plurality of toner boxes 9K, 9Y, 9M, 9C has a housing 91, an auger 93 (refer to FIG. 11A), a supply unit (one example of a supply device) 90, and a shutter 94. Each of the plurality of toner boxes 9K, 9Y, 9M, 9C has the same structure. Therefore, the toner box 9M is described, and the descriptions of the toner boxes 9K, 9Y, 9C are omitted.

3.3.1 Housing and Auger

Figure 11B:
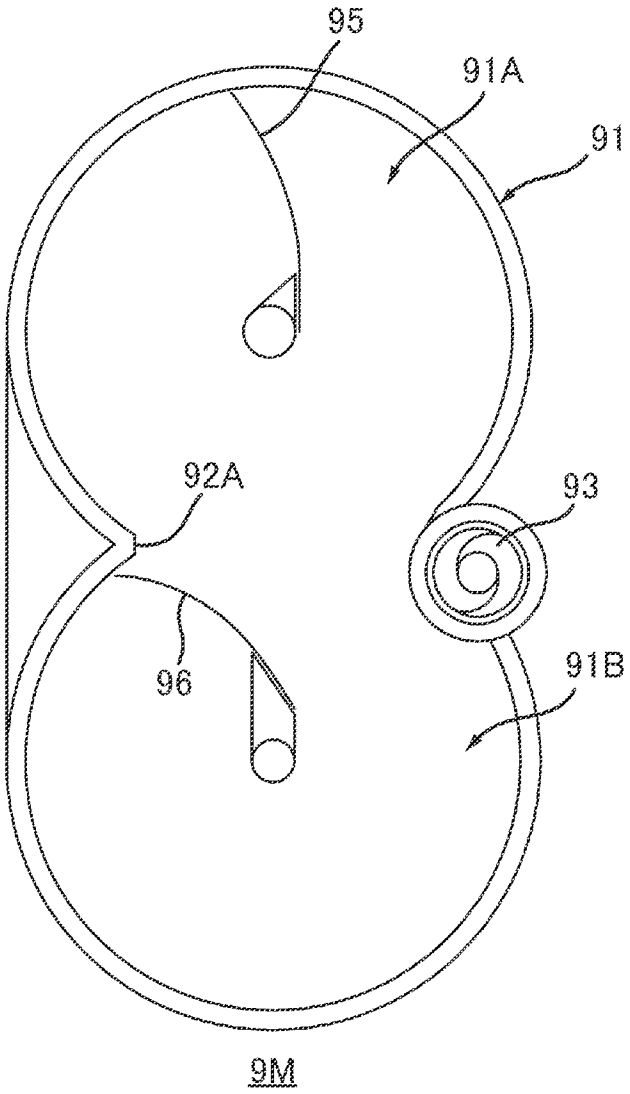
FIG. 11B is a second schematic configuration view of the toner box shown in FIG. 8.
Figure 11A:
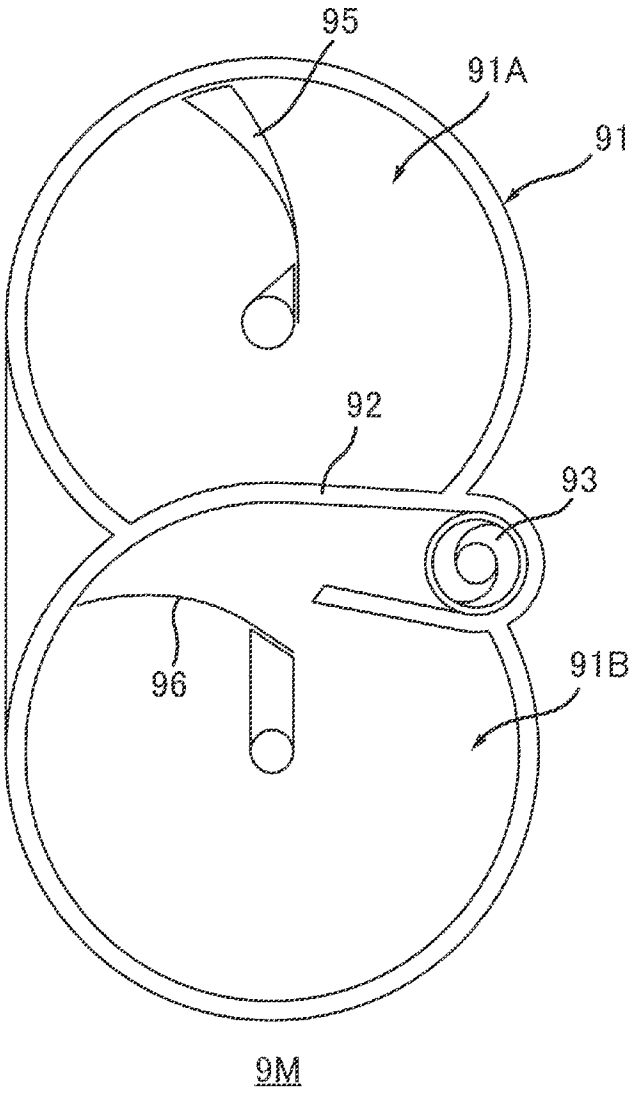
FIG. 11A is a first schematic configuration view of the toner box shown in FIG. 8.

As shown in FIGS. 11A and 11B, the housing 91 is configured to accommodate therein the toner. The housing 91 has a partitioning wall 92 and a communication opening 92A.

The partitioning wall 92 is configured to partition an internal space of the housing 91 into a first accommodation chamber 91A and a second accommodation chamber 91B. The partitioning wall 92 is arranged in the housing 91. The partitioning wall 92 extends in the axis direction. The first accommodation chamber 91A is located above the second accommodation chamber 91B, in a state where the toner box 9M is located at the coupling position. A first agitator 95 is arranged in the first accommodation chamber 91A. A second agitator 96 is arranged in the second accommodation chamber 91B.

The communication opening 92A is arranged at the partitioning wall 92. The communication opening 92A is formed to communicate the first accommodation chamber 91A and the second accommodation chamber 91B each other.

The auger 93 is configured to convey the toner in the second accommodation chamber 91B toward the supply unit 90. The auger 93 extends in the axis direction.

3.3.2 Supply Unit and Shutter

As shown in FIG. 8, the supply unit 90 is arranged on an outer surface of the housing 91 in the axis direction. The supply unit 90 has a cylindrical shape. The supply unit 90 extends in the axis direction. The supply unit 90 has one end and the other end in the axis direction. One end of the supply unit 90 is fixed to the housing 91. The other end of the supply unit 90 is closed. An internal space of the supply unit 90 is formed to communicate with an internal space of the housing 91. Specifically, the supply unit 90 is configured to communicate with the second accommodation chamber 91B (refer to FIG. 11A). For this reason, it is possible to supply the toner accommodated in the housing 91 from the second accommodation chamber 91B to the supply unit 90.

The supply unit 90 can be coupled with the receiving part 43 of each of the plurality of cartridges 4K, 4Y, 4M, 4C (refer to FIG. 7). The supply unit 90 can supply the toner to the receiving part 43 of each of the plurality of cartridges 4K, 4Y, 4M, 4C.

The supply unit 90 has a toner passage opening 90A. The toner passage opening 90A is formed to allow the toner to pass therethrough. The toner passage opening 90A is located at a lower end of the supply unit 90 in the state where the toner box 9M is located at the coupling position.

The shutter 94 is arranged on a peripheral surface of the supply unit 90. The shutter 94 is configured to be movable between a closing position at which the toner passage opening 90A is closed and an opening position at which the toner passage opening 90A is opened.

3.3.3 Coupling Position of Toner Box

Each of the plurality of toner boxes 9K, 9Y, 9M, 9C is configured to be movable between a coupling position (refer to FIG. 8) and a decoupling position (refer to FIG. 9) in a state where the toner box is mounted to the apparatus main body 2. In the exemplary embodiment, each of the plurality of toner boxes 9K, 9Y, 9M, 9C is configured to be rotatable among the coupling position (refer to FIG. 8), the decoupling position (refer to FIG. 9), and a separable position (refer to FIG. 10B) in the state where the toner box is mounted to the apparatus main body 2. For this reason, it is possible to smoothly move each of the plurality of toner boxes 9K, 9Y, 9M, 9C to the coupling position, the decoupling position and the separable position.

In a state where each of the plurality of toner boxes 9K, 9Y, 9M, 9C is located at the coupling position, the supply unit 90 of each of the plurality of toner boxes 9K, 9Y, 9M, 9C is coupled with the receiving part 43 of each of the plurality of cartridges 4K, 4Y, 4M, 4C (refer to FIG. 7). Specifically, in a state where the toner box 9K is located at the coupling position, the supply unit 90 of the toner box 9K is coupled with the receiving part 43 of the cartridge 4K. In a state where the toner box 9Y is located at the coupling position, the supply unit 90 of the toner box 9Y is coupled with the receiving part 43 of the cartridge 4Y. In a state where the toner box 9M is located at the coupling position, the supply unit 90 of the toner box 9M is coupled with the receiving part 43 of the cartridge 4M. In a state where the toner box 9C is located at the coupling position, the supply unit 90 of the toner box 9C is coupled with the receiving part 43 of the cartridge 4C. In the meantime, each of the plurality of toner boxes 9K, 9Y, 9M, 9C is arranged in the same manner at each of the coupling position, the decoupling position and the separable position. Therefore, the toner box 9M that is located at each of the coupling position, the decoupling position and the separable position is described, and the descriptions of the toner boxes 9K, 9Y, 9C are omitted.

In the state where the toner box 9M is located at the coupling position, the supply unit 90 is fitted to the toner coupling wall 74. In a state where each of the shutter 75 and the shutter 94 is located at the opening position, the toner passage opening 90A of the supply unit 90 and the toner receiving opening 73A of the toner receiving wall 73 communicate with each other. Thereby, it is possible to supply toner accommodated in the housing 91 from the supply unit 90 to the toner receiving wall 73.

Also, the first wall 20 is located between the cartridge 4M and the toner box 9M located at the coupling position. Specifically, the first wall 20 is located between the cartridge 4M and the housing 91 of the toner box 9M located at the coupling position, in the axis direction.

The first wall 20 has a plurality of second holes 20B. Each of the plurality of second holes 20B is formed to face the toner coupling wall 74 of the receiving part 43 in the axis direction in the state where the drawer 3 is located at the inner position. The second hole 20B receives the supply unit 90 in the state where the toner box 9M is located at the coupling position.

3.3.4 Decoupling Position of Toner Box

As shown in FIG. 9, in the state where the toner box 9M is located at the decoupling position, the toner box 9M is located more distant from the cartridge 4M than at the first position. In the state where the toner box 9M is located at the decoupling position, the supply unit 90 and the receiving part 43 are decoupled. Specifically, in the state where the toner box 9M is located at the decoupling position, the supply unit 90 is separated from the toner coupling wall 74.

In the state where the toner box 9M is located at the decoupling position, the supply unit 90 is located at an opposite side to the receiving part 43 with respect to the first wall 20. For this reason, when the drawer 3 is moved to the inner position and the outer position, it is possible to suppress the supply unit 90 from being an obstacle.

In the meantime, in the state where the toner box 9M is located at the decoupling position, an upper wall of the apparatus main body 2 is located downstream of the toner box 9M located at the decoupling position with respect to the separation direction of the toner box 9M from the apparatus main body 2. For this reason, the toner box 9M cannot be separated from the apparatus main body 2 in the state where the toner box 9M is located at the decoupling position.

3.3.5 Separable Position of Toner Box

As shown in FIG. 10B, in a state where the toner box 9M is located at the separable position, the toner box 9M is located more distant from the coupling position (refer to FIG. 8) that the decoupling position (refer to FIG. 9). In the state where the toner box 9M is located at the separable position, a distance between the supply unit 90 and the receiving part 43 is greater than a distance in the state where the toner box 9M is located at the decoupling position. Specifically, when the toner box 9M is moved from the decoupling position to the separable position, a second accommodation frame 33 (which will be described later) configured to support the toner box 9M rotates about a rotary shaft 34 (which will be described later), which is a support point, and is thus tilted so as to be distant from the first wall 20.

Thereby, in the state where the toner box 9M is located at the separable position, the upper wall of the apparatus main body 2 is not located downstream of the toner box 9M located at the separable position with respect to the separation direction of the toner box 9M from the apparatus main body 2. For this reason, the toner box 9M can be separated from the apparatus main body 2 in the state where the toner box 9M is located at the separable position.

3.4 Second Support Part

As shown in FIG. 8, the apparatus main body 2 is configured to support the plurality of toner boxes 9K, 9Y, 9M, 9C so that each of the plurality of toner boxes 9K, 9Y, 9M, 9C can move. The apparatus main body 2 further includes a plurality of second support part 27K (not shown), 27Y (not shown), 27M and 27C (not shown). The plurality of second support part 27K (not shown), 27Y (not shown), 27M and 27C (not shown) has the same structure. Therefore, in the below, the second support part 27M is described, and the descriptions of the second support parts 27K, 27Y, 27C are omitted.

The second support part 27M is configured to support the toner box 9M. The second support part 27M is located above the first support part 26. The second support part 27M is supported to the first wall 20. The second support part 27M has a rotary shaft 34 and a second accommodation frame 33.

The rotary shaft 34 extends in the alignment direction. The rotary shaft 34 is rotatably supported to the first wall 20.

The second accommodation frame 33 can accommodate therein the toner box 9M. The second accommodation frame 33 has a third side frame 33A, a fourth side frame 33B, and a mounting/demounting opening 33C.

The third side frame 33A is located at one end of the second accommodation frame 33 in the axis direction. The fourth side frame 33B is located at the other end of the second accommodation frame 33 in the axis direction. The third side frame 33A is located at an opposite side to the first wall 20 with respect to the housing 91, in the state where the toner box 9M is located at the coupling position. The fourth side frame 33B is located between the housing 91 and the first wall 20 in the state where the toner box 9M is located at the coupling position. Each of the third side frame 33A and the fourth side frame 33B extends in the vertical direction in the state where the toner box 9M is located at the coupling position. The third side frame 33A is configured to close an upper part of the second opening 21A in the state where the toner box 9M is located at the coupling position.

The mounting/demounting opening 33C is formed to allow the toner box 9M to pass therethrough when mounting and demounting the toner box 9M to and from the second accommodation frame 33. The mounting/demounting opening 33C is defined between an upper end of the third side frame 33A and an upper end of the fourth side frame 33B.

The second accommodation frame 33 is mounted to the rotary shaft 34. Specifically, a lower end portion of the second accommodation frame 33 is fixed to the rotary shaft 34. Thereby, the toner box 9M rotates about the rotary shaft 34 in the state where it is supported to the second support part 27M. That is, a rotation support point of the toner box 9M is the rotary shaft 34 and is supported to the first wall 20.

As shown in FIG. 9, when the toner box 9M is moved from the coupling position (refer to FIG. 8) to the decoupling position, the second accommodation frame 33 is tilted so as to be distant from the first wall 20 about the rotary shaft 34, which is a support point. In the state where the toner box 9M is located at the decoupling position, the toner box 9M overlaps the upper wall of the apparatus main body 2 in the separation direction from the apparatus main body 2, specifically, in the extension direction of the third side frame 33A. For this reason, in the state where the toner box 9M is located at the decoupling position, the toner box 9M cannot be separated from the second support part 27M.

As shown in FIG. 10B, when the toner box 9M is moved from the decoupling position (refer to FIG. 9) to the separable position, the second accommodation frame 33 is tilted so as to be more distant from the first wall 20 than at the decoupling position (refer to FIG. 9) about the rotary shaft 34, which is a support point. In the state where the toner box 9M is located at the separable position, the toner box 9M does not overlap the upper wall of the apparatus main body 2 in the separation direction from the apparatus main body 2, specifically, in the extension direction of the third side frame 33A. Also, the mounting/demounting opening 33C is exposed from the upper part of the second opening 21A. For this reason, the toner box 9M can be separated from the second accommodation frame 33 through the mounting/demounting opening 33C and the second opening 21A.

Also, when the waste toner box 5 is located at the first position and the toner box 9M is moved from the coupling position (refer to FIG. 8) to the decoupling position (refer to FIG. 9) or the separable position, the third side frame 33A comes in contact with the movable frame 31C. For this reason, the movable frame 31C swings to be distant from the first wall 20 about a lower end of the movable frame 31C, which is a support point, in association with movement of the second accommodation frame 33.

3.5 First Pressing Unit

Also, as shown in FIG. 7, the image forming apparatus 1 further includes a plurality of first pressing units 28A, 28B, a plurality of second pressing units 29K, 29Y, 29M, 29C, a first link member 7, a first guide 37, a second guide 38, a coupling part 81, a second link member 8, and a third guide 39.

The first pressing units 28A, 28B are configured to press the waste toner box 5 so that the waste toner box 5 is to face from the first position toward the second position (refer to FIG. 8). The first pressing units 28A, 28B are located with being spaced from each other in the alignment direction. The first pressing units 28A, 28B are arranged in the first guide 37. The first guide 37 will be described later. Also, the first pressing units 28A, 28B have the same structure. Therefore, in the below, the first pressing unit 28A is described, and the description of the first pressing unit 28B is omitted.

As shown in FIG. 8, the first pressing unit 28A is located at an opposite side to the first accommodation frame 31 with respect to the first wall 20, in the axis direction. The first pressing unit 28A is located at an opposite side to the box main body 52 with respect to the second side frame 31B, in the axis direction. The first pressing unit 28A is located between the coupling part 50M and the rotary shaft 32 in the vertical direction in the state where the waste toner box 5 is located at the first position. The first pressing unit 28A has a spring 23 and a first contact part 35. That is, the image forming apparatus 1 includes the spring 23.

The spring 23 is provided to press the waste toner box 5 from the first position toward the second position (refer to FIG. 9). The spring 23 is located between the coupling part 50M and the rotary shaft 32, in the state where the waste toner box 5 is located at the first position. In other words, the spring 23 is located between the coupling part 50M and the rotation support point of the waste toner box 5 in the vertical direction in the state where the waste toner box 5 is located at the first position. For this reason, it is possible to effectively arrange the spring 23.

The first contact part 35 is in contact with the second side frame 31B through a third hole 20C of the first wall 20. The first contact part 35 is pressed toward the second side frame 31B by the spring 23. The first contact part 35 has a cylindrical shape. The first contact part 35 extends in the axis direction. The first contact part 35 is configured to accommodate therein the spring 23.

3.6 Second Pressing Unit

As shown in FIG. 7, the plurality of second pressing units 29K, 29Y, 29M, 29C is configured to press the plurality of toner boxes 9K, 9Y, 9M, 9C so that the plurality of toner boxes 9K, 9Y, 9M, 9C is to face from the coupling position (refer to FIG. 8) toward the decoupling position (refer to FIG. 9). The plurality of second pressing units 29K, 29Y, 29M, 29C is located with being spaced from each other in the alignment direction. The plurality of second pressing units 29K, 29Y, 29M, 29C is arranged in the second guide 38. The second guide 38 will be described later. The plurality of second pressing units 29K, 29Y, 29M, 29C has the same structure. Therefore, in the below, the second pressing unit 29M is described, and the descriptions of the plurality of second pressing units 29K, 29Y, 29C are omitted.

As shown in FIG. 8, the second pressing unit 29M is located at an opposite side to the second accommodation frame 33 with respect to the first wall 20, in the axis direction. The second pressing unit 29M is located at an opposite side to the housing 91 with respect to the fourth side frame 33B, in the axis direction. The second pressing unit 29M is located between the supply unit 90 and the rotary shaft 34 in the vertical direction, in the state where the toner box 9M is located at the coupling position. The second pressing unit 29M has a second spring 25 and a second contact part 36.

The second spring 25 is provided to press the toner box 9M from the coupling position toward the decoupling position (refer to FIG. 9). The second spring 25 is located between the supply unit 90 and the rotation support point of the toner box 9M, in the state where the toner box 9M is located at the coupling position.

The second contact part 36 is in contact with the fourth side frame 33B through a fourth hole 20D of the first wall 20. The second contact part 36 is pressed toward the fourth side frame 33B by the second spring 25. The second contact part 36 has a cylindrical shape. The second contact part 36 extends in the axis direction. The second contact part 36 is configured to accommodate therein the second spring 25.

3.7 First Link Member

The first link member 7 is configured to interlink movement of the cover 2B and pressing and press-releasing of the spring 23 with respect to the waste toner box 5. The first link member 7 is configured to restrain the pressing of the spring 23 to the waste toner box 5 in a state where the cover 2B is located at the closing position. The first link member 7 allows the spring 23 to press the waste toner box 5 when the cover 2B is moved from the closing position to the opening position (refer to FIG. 9). For this reason, when the cover 2B is moved from the closing position to the opening position, the waste toner box 5 can be securely located at the second position.

Also, the first link member 7 is configured to interlink movement of the cover 2B and pressing and press-releasing of the second spring 25 with respect to the toner box 9M. The first link member 7 is configured to restrain the pressing of the second spring 25 to the toner box 9M in a state where the cover 2B is located at the closing position. The first link member 7 allows the second spring 25 to press the toner box 9M when the cover 2B is moved from the closing position to the opening position (refer to FIG. 9).

As shown in FIG. 7, the first link member 7 has a first part 77, a second part 78, a connection part 79, and a first boss 80.

3.7.1 First Part

The first part 77 extends in the alignment direction. The first part 77 is located at an opposite side to the first accommodation frame 31 with respect to the first wall 20 in the axis direction (refer to FIG. 8). The first part 77 is located below the discharge part 41 in the state where the drawer 3 is located at the inner position. The first part 77 has a plurality of first through-openings 82A, 82B, and a plurality of first cams 83A, 83B (refer to FIG. 13).

The plurality of first through-openings 82A, 82B is located with being spaced from each other in the alignment direction. The plurality of first through-openings 82A, 82B has the same structure. Therefore, in the below, the first through-opening 82A is described, and the description of the first through-opening 82B is omitted.

The first through-opening 82A is formed to receive the first contact part 35 of the first pressing unit 28A. The first through-opening 82A extends in the alignment direction. The first through-opening 82A has one end and the other end in the alignment direction. The first contact part 35 is located at one end of the first through-opening 82A in the state where the cover 2B is located at the closing position. The first contact part 35 is located at the other end of the first through-opening 82A in the state where the cover 2B is located at the opening position (refer to FIG. 12).

Figure 13:
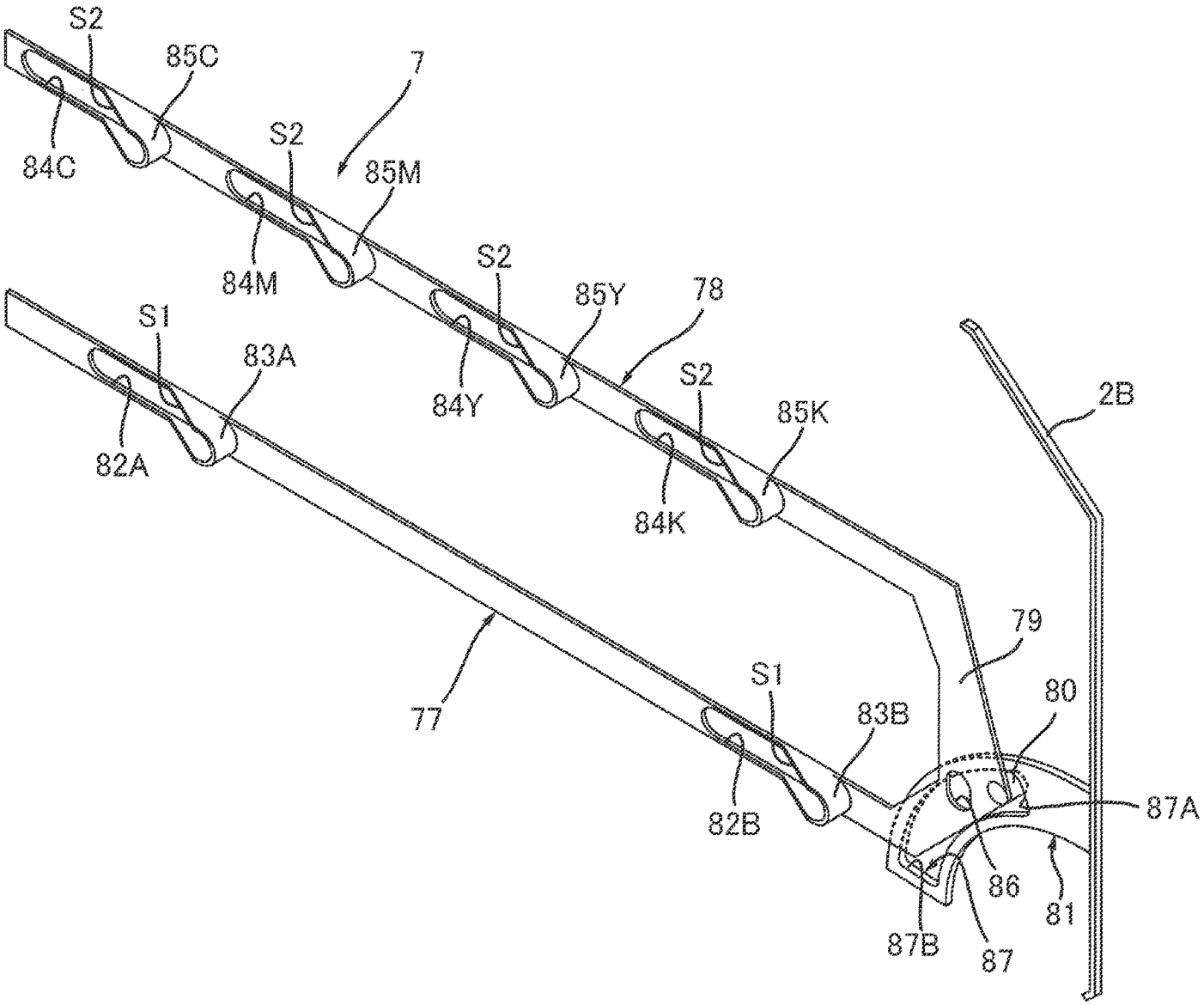
FIG. 13 is a perspective view of a first link member shown in FIG. 7.

As shown in FIG. 13, the plurality of first cams 83A, 83B is located with being spaced from each other in the alignment direction. The plurality of first cams 83A, 83B has the same structure. Therefore, in the below, the first cam 83A is described, and the description of the first cam 83B is omitted. The first cam 83A is located at an opposite side to the first wall 20 with respect to the first part 77 (refer to FIG. 8). The first cam 83A is configured to surround one end of the first through-opening 82A. The first cam 83A protrudes from one end edge of the first through-opening 82A of the first part 77 in the axis direction. The first cam 83A has an inclined surface S1. The inclined surface S1 is inclined to intersect with the axis direction.

As shown in FIG. 8, the first cam 83A is in contact with the first contact part 35 in the state where the cover 2B is located at the closing position. Thereby, the first contact part 35 separates from the first accommodation frame 31 in the axis direction, against a pressing force of the spring 23. For this reason, the pressing of the spring 23 to the waste toner box 5 is restrained.

As shown in FIG. 9, the first cam 83A is in contactless with the first contact part 35 in the state where the cover 2B is located at the opening position. Thereby, the first contact part 35 comes in contact with the first accommodation frame 31 by the pressing force of the spring 23, thereby pressing the first accommodation frame 31. For this reason, the restraint on the pressing of the spring 23 to the waste toner box 5 is released. Then, the spring 23 presses the waste toner box 5.

3.7.2 Second Part

As shown in FIG. 7, the second part 78 extends in the alignment direction. The second part 78 is located at an opposite side to the second accommodation frame 33 with respect to the first wall 20 in the axis direction (refer to FIG. 8). The second part 78 is located at an opposite side to the first part 77 with respect to the discharge part 41, in the state where the drawer 3 is located at the inner position. The second part 78 is located between the discharge part 41 and the receiving part 43, in the state where the drawer 3 is located at the inner position. The second part 78 has a plurality of second through-openings 84K, 84Y, 84M, 84C, and a plurality of second cams 85K, 85Y, 85M, 85C (refer to FIG. 13).

The plurality of second through-openings 84K, 84Y, 84M, 84C is located with being spaced from each other in the alignment direction. The plurality of second through-openings 84K, 84Y, 84M, 84C has the same structure. Therefore, in the below, the second through-opening 84M is described, and the descriptions of the second through-openings 84K, 84Y, 84C are omitted. The second through-opening 84M is formed to receive the second contact part 36 of the second pressing unit 29M. The second through-opening 84M extends in the alignment direction. The second through-opening 84M has one end and the other end in the alignment direction. The second contact part 36 is located at one end of the second through-opening 84M in the state where the cover 2B is located at the closing position. The second contact part 36 is located at the other end of the second through-opening 84M in the state where the cover 2B is located at the opening position (refer to FIG. 12).

As shown in FIG. 13, the plurality of second cams 85K, 85Y, 85M, 85C is located at an opposite side to the first wall 20 with respect to the second part 78 (refer to FIG. 8). The plurality of second cams 85K, 85Y, 85M, 85C is located with being spaced from each other in the alignment direction. The plurality of second cams 85K, 85Y, 85M, 85C has the same structure. Therefore, in the below, the second cam 85M is described, and the descriptions of the second cams 85K, 85Y, 85C are omitted.

The second cam 85M is configured to surround one end of the second through-opening 84M. The second cam 85M protrudes from one end edge of the second through-opening 84M of the second part 78 in the axis direction. The second cam 85M has an inclined surface S2. The inclined surface S2 is inclined to intersect with the axis direction.

As shown in FIG. 8, the second cam 85M is in contact with the second contact part 36 in the state where the cover 2B is located at the closing position. Thereby, the second contact part 36 separates from the second accommodation frame 33 in the axis direction, against a pressing force of the second spring 25. For this reason, the pressing of the second spring 25 to the toner box 9M is restrained.

As shown in FIG. 9, the second cam 85M is in contactless with the second contact part 36 in the state where the cover 2B is located at the opening position. Thereby, the second contact part 36 comes in contact with the second accommodation frame 33 by the pressing force of the second spring 25, thereby pressing the second accommodation frame 33. For this reason, the restraint on the pressing of the second spring 25 to the toner box 9M is released. Then, the second spring 25 presses the toner box 9M.

3.7.3 Connection Part and Boss

As shown in FIG. 13, the connection part 79 is configured to interconnect the first part 77 and the second part 78. The connection part 79 extends in the vertical direction. The connection part 79 is located with being spaced from the cover 2B in the alignment direction. The connection part 79 has a receiving hole 86. The receiving hole 86 is formed to receive a second boss 89 of the second link member 8. The second boss 89 will be described later.

The first boss 80 extends in the axis direction. The first boss 80 is fixed to the connection part 79.

3.7.4 Coupling Part

The coupling part 81 is configured to couple the cover 2B and the first link member 7 each other. The coupling part 81 is arranged in alignment with the connection part 79 in the axis direction. The coupling part 81 has a circular arc shape of which a center is the rotation support point of the cover 2B. The coupling part 81 is fixed to the cover 2B. The coupling part 81 has a long hole 87. The long hole 87 is formed to receive the first boss 80. The long hole 87 extends in a rotating direction of the cover 2B. The long hole 87 has one end 87A and the other end 87B in an extension direction of the long hole 87. The other end 87B of the long hole 87 is located at an opposite side to the cover 2B with respect to one end 87A of the long hole 87 in the extension direction of the long hole 87. The first boss 80 is located at one end 87A of the long hole 87 in the state where the cover 2B is located at the closing position. The first boss 80 is located at the other end 87B of the long hole 87 in the state where the cover 2B is located at the opening position (refer to FIG. 12).

3.8 First Guide and Second Guide

As shown in FIG. 7, the first guide 37 guides the first part 77 when the cover 2B is moved between the closing position and the opening position. The first guide 37 extends in the alignment direction. The first guide 37 is configured to slidably accommodate the first part 77. The first guide 37 is fixe to the first wall 20. The second guide 38 guides the second part 78 when the cover 2B is moved between the closing position and the opening position. The second guide 38 extends in the alignment direction. The second guide 38 is configured to slidably accommodate the second part 78. The second guide 38 is located with being spaced upward from the first guide 37.

3.8 Second Link Member and Third Guide

The second link member 8 is configured to interlink movement of the cover 2B and movement of the drawer 3. The drawer 3 is configured to be movable between the contact position (refer to FIG. 1) and the spaced position (refer to FIG. 12) in the state where the drawer is located at the inner position. In the state where the drawer 3 is located at the contact position, the photosensitive drums 40 of the plurality of cartridges 4K, 4Y, 4M, 4C are in contact with the belt unit 6 (refer to FIG. 1). In the state where the drawer 3 is located at the spaced position, the photosensitive drums 40 of the plurality of cartridges 4 are spaced from the belt unit 6 (refer to FIG. 12). In the state where the cover 2B is located at the closing position, the second link member 8 locates the drawer 3 at the contact position (refer to FIG. 1). The second link member 8 moves the drawer 3 from the contact position to the spaced position (refer to FIG. 12) when the cover 2B is moved from the closing position to the opening position. For this reason, when the cover 2B is moved from the closing position to the opening position, it is possible to securely space the drawer 3 from the belt unit 6. As a result, it is possible to secure smooth movement of the drawer 3.

Figure 14:
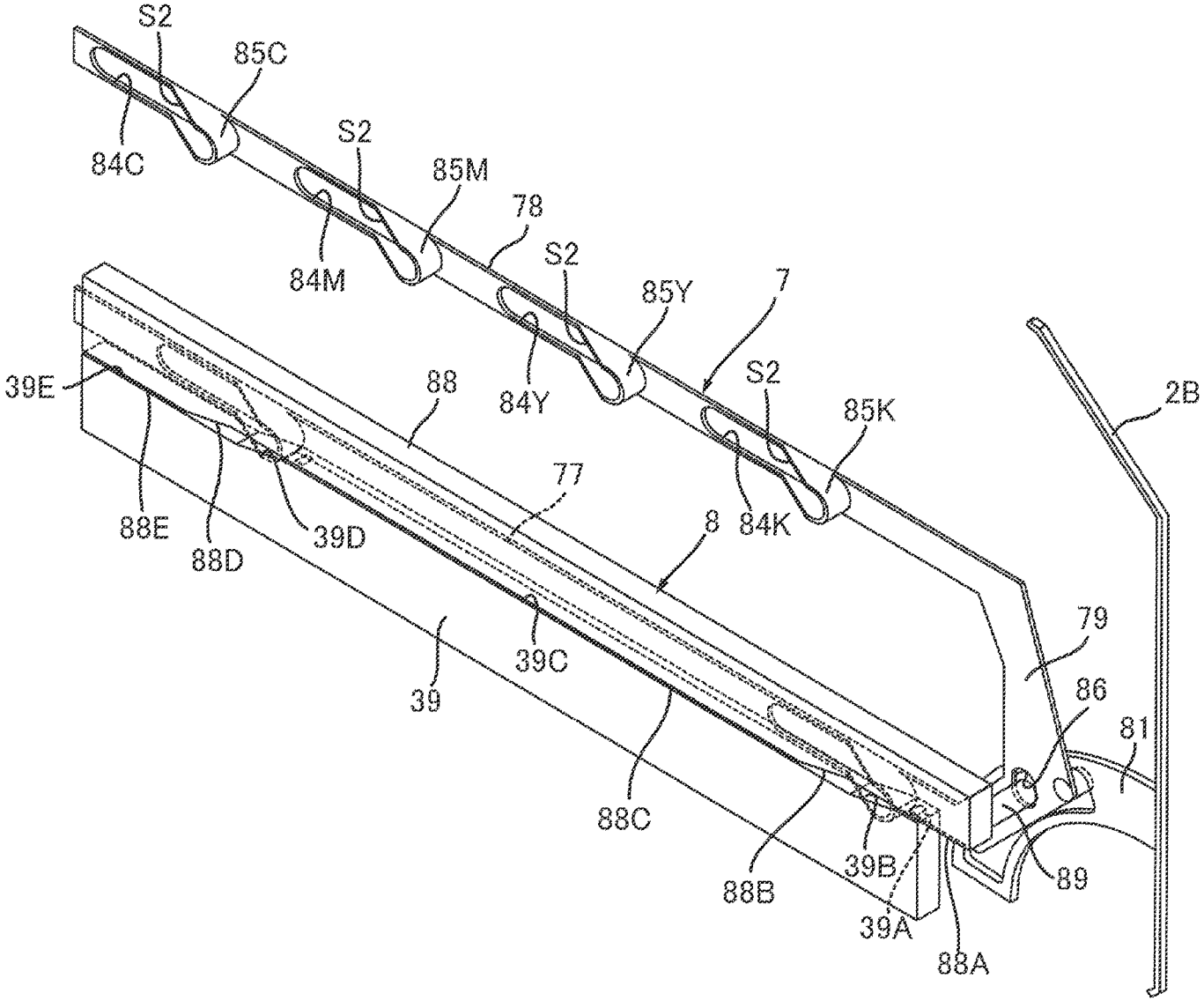
FIG. 14 is a perspective view of the first link member and a second link member shown in FIG. 7.

As shown in FIG. 14, the second link member 8 is located between the first part 77 and the second part 78 in the vertical direction (refer to FIG. 7). The second link member 8 has a link main body 88 and a second boss 89.

3.8.1 Link Main Body 88

The link main body 88 extends in the alignment direction. The link main body 88 is located at an opposite side to the coupling part 81 with respect to the first link member 7 in the axis direction. The link main body 88 is located below the drawer 3 in the state where the drawer 3 is located at the inner position (refer to FIG. 8). An upper surface of the link main body 88 is in contact with the drawer 3 in the state where the drawer 3 is located at the inner position (refer to FIG. 8). A lower surface of the link main body 88 has a first surface 88A, a second surface 88B, a third surface 88C, a fourth surface 88D, and a fifth surface 88E.

The first surface 88A is located at an end portion of the lower surface of the link main body 88 facing toward the cover 2B. The first surface 88A extends in the alignment direction. The second surface 88B is located at an opposite side to the cover 2B with respect to the first surface 88A. The second surface 88B is inclined to intersect with the vertical direction. The second surface 88B has one end and the other end in the alignment direction. One end of the second surface 88B continues to the first surface 88A. The other end of the second surface 88B is located at a position lower than one end of the second surface 88B. The other end of the second surface 88B continues to the third surface 88C.

The third surface 88C is located at an opposite side to the cover 2B with respect to the second surface 88B. The third surface 88C extends in the alignment direction. The fourth surface 88D is located at an opposite side to the cover 2B with respect to the third surface 88C. The fourth surface 88D is inclined to intersect with the vertical direction. The fourth surface 88D has one end and the other end in the alignment direction. One end of the fourth surface 88D continues to the third surface 88C. The other end of the fourth surface 88D is located at a position lower than one end of the fourth surface 88D. The other end of the fourth surface 88D continues to the fifth surface 88E. The fifth surface 88E is located at an opposite side to the cover 2B with respect to the fourth surface 88D. The fifth surface 88E extends in the alignment direction.

3.8.2 Second Boss

Also, when the cover 2B is moved from the closing position to the opening position, the first link member 7 and the second link member 8 are coupled with each other so that the first link member 7 first allows the spring 23 to press the waste toner box 5 and then the second link member 8 moves the drawer 3 from the contact position to the spaced position. For this reason, when the cover 2B is moved from the closing position to the opening position, the waste toner box 5 is first located at the first position, so that the coupling part 50M and the discharge part 41 can be decoupled and then the drawer 3 can be moved from the contact position to the spaced position.

Specifically, the second boss 89 is inserted in the receiving hole 86. Thereby, the second link member 8 is coupled with the first link member 7. The second boss 89 is fixed to the link main body 88. The second boss 89 extends in the axis direction.

3.9 Third Guide

When the cover 2B is moved between the closing position and the opening position, the third guide 39 guides the second link member 8. The third guide 39 is located below the second link member 8.

The third guide 39 extends in the alignment direction. The third guide 39 is fixed to the apparatus main body 2. An upper surface of the third guide 39 is in contact with a lower surface of the link main body 88. The upper surface of the third guide 39 has a first guide surface 39A, a second guide surface 39B, a third guide surface 39C, a fourth guide surface 39D, and a fifth guide surface 39E.

The first guide surface 39A is located at an end portion of the upper surface of the third guide 39 facing toward the cover 2B. The first guide surface 39A extends in the alignment direction. The first guide surface 39A is in contact with the first surface 88A in the state where the cover 2B is located at the closing position. The first guide surface 39A is in contact with the third surface 88C in the state where the cover 2B is located at the opening position (refer to FIG. 12).

The second guide surface 39B is located at an opposite side to the cover 2B with respect to the first guide surface 39A. The second guide surface 39B is inclined to intersect with the vertical direction. The second guide surface 39B has one end and the other end in the alignment direction. One end of the second guide surface 39B continues to the first guide surface 39A. The other end of the second guide surface 39B is located at a position lower than one end of the second guide surface 39B. The other end of the second guide surface 39B continues to the third guide surface 39C. The second guide surface 39B faces the second surface 88B in the alignment direction, in the state where the cover 2B is located at the closing position. The second guide surface 39B comes in contact with the second surface 88B when the cover 2B is moved between the closing position and the opening position.

The third guide surface 39C is located at an opposite side to the cover 2B with respect to the second guide surface 39B. The third guide surface 39C extends in the alignment direction. The third guide surface 39C is in contact with the third surface 88C in the state where the cover 2B is located at the closing position. The third guide surface 39C is in contact with the fifth surface 88E in the state where the cover 2B is located at the opening position (refer to FIG. 12).

The fourth guide surface 39D is located at an opposite side to the cover 2B with respect to the third guide surface 39C. The fourth guide surface 39D is inclined to intersect with the vertical direction. The fourth guide surface 39D has one end and the other end in the alignment direction. One end of the fourth guide surface 39D continues to the third guide surface 39C. The other end of the fourth guide surface 39D is located at a position lower than one end of the fourth guide surface 39D. The other end of the fourth guide surface 39D continues to the fifth guide surface 39E. The fourth guide surface 39D faces the fourth surface 88D in the alignment direction, in the state where the cover 2B is located at the closing position. The fourth guide surface 39D comes in contact with the fourth surface 88D when the cover 2B is moved between the closing position and the opening position.

The fifth guide surface 39E is located at an opposite side to the cover 2B with respect to the fourth guide surface 39D. The fifth guide surface 39E extends in the alignment direction. The fifth guide surface 39E is in contact with the fifth surface 88E in the state where the cover 2B is located at the closing position.

4. Operations of Waste Toner Box, Toner Box and Drawer

Subsequently, operations of the waste toner box 5, the toner box 9M and the drawer 3 are described with reference to FIGS. 2, 9 to 10B and 12.

Figure 12:
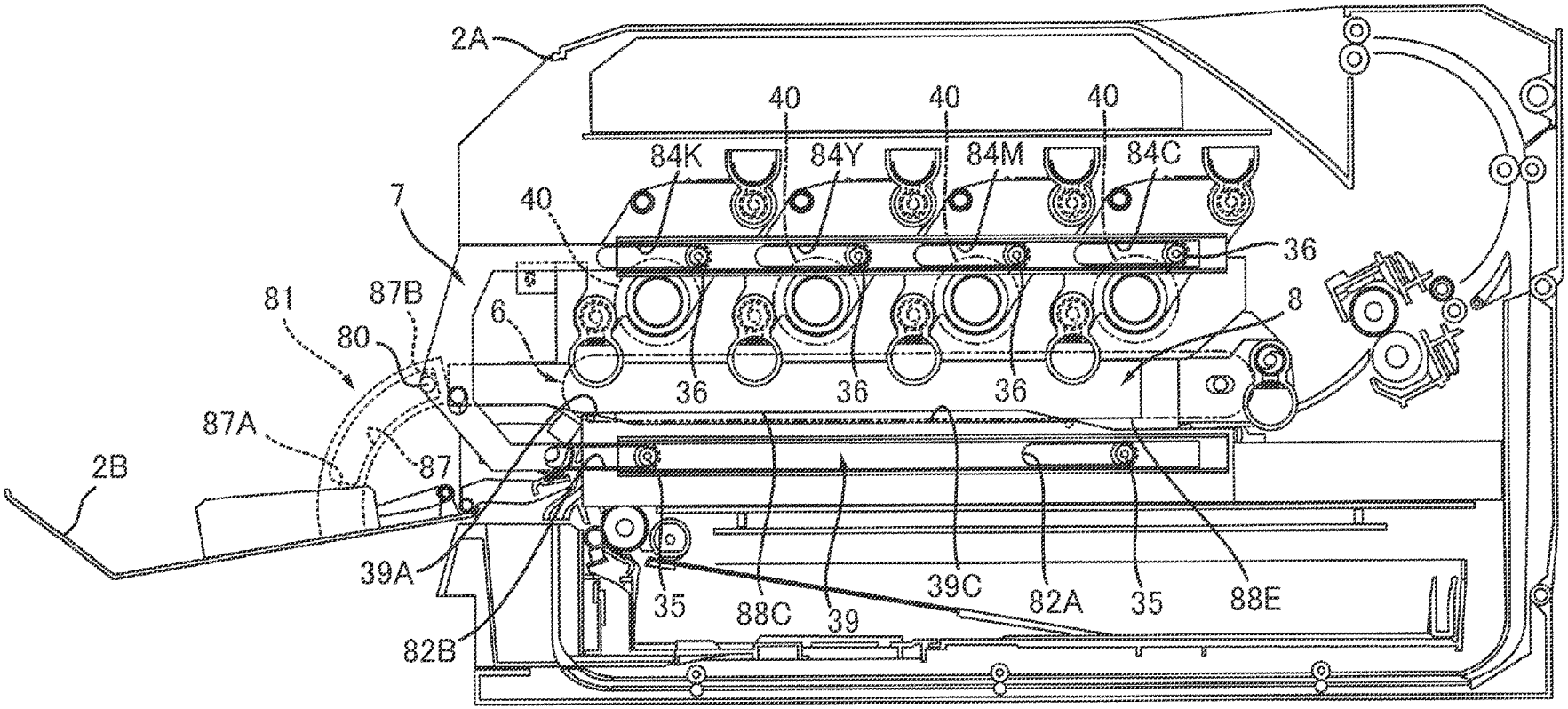
FIG. 12 depicts the image forming apparatus shown in FIG. 7, in which a cover is located at an opening position.

As shown in FIG. 12, when the cover 2B is moved from the closing position to the opening position, the other end 87B of the long hole 87 comes in contact with the first boss 80. Then, the first link member 7 is moved toward the opening 2A in the alignment direction, and the second link member 8 is moved toward the opening 2A in the alignment direction.

Then, as shown in FIG. 9, the contact between the first contact part 35 and the first cam 83A is first released by the movement of the first link member 7. Then, the first contact part 35 is brought into contact with the first accommodation frame 31 by the pressing force of the spring 23, thereby pressing the first accommodation frame 31. That is, the first link member 7 allows the spring 23 to press the waste toner box 5. Thereby, the waste toner box 5 is moved from the first position to the second position.

At this time, the contact between the second contact part 36 and the second cam 85M is released by the movement of the first link member 7. Then, the second contact part 36 is brought into contact with the second accommodation frame 33 by the pressing force of the second spring 25, thereby pressing the second accommodation frame 33. Thereby, the toner box 9M is moved from the coupling position to the decoupling position.

Then, as shown in FIG. 12, the third surface 88C is brought into contact with the first guide surface 39A and the fifth surface 88E is brought into contact with the third guide surface 39C by the movement of the second link member 8. Thereby, the second link member 8 is moved upward, and the drawer 3 is moved from the contact position to the spaced position.

Thereafter, as shown in FIG. 2, when the drawer 3 supporting the plurality of cartridges 4K, 4Y, 4M, 4C is moved from the inner position to the outer position, a user can mount and demount the plurality of cartridges 4K, 4Y, 4M, 4C to and from the drawer 3.

Also, as shown in FIG. 10A, in order to separate the waste toner box 5 from the apparatus main body 2, the user rotates the first accommodation frame 31 to locate the waste toner box 5 at the third position. Thereby, the user can mount and demount the waste toner box 5 to and from the first accommodation frame 31. In the meantime, in the state where the waste toner box 5 is located at the third position, the toner box 9M may be located at the coupling position or the decoupling position.

Also, as shown in FIG. 10B, in order to separate the toner box 9M from the apparatus main body 2, the user rotates the second accommodation frame 33 to locate the toner box 9M at the separable position. Thereby, the user can mount and demount the toner box 9M to and from the second accommodation frame 33. In the meantime, in the state where the toner box 9M is located at the separable position, the waste toner box 5 may be located at the first position or the second position.

5. Advantages

As shown in FIG. 8, in the state where the waste toner box 5 is located at the first position, the plurality of coupling parts 50K, 50Y, 50M, 50C can receive the waste toner from the plurality of discharge parts 41 (refer to FIG. 7).

For this reason, the drawer 3 can accommodate the waste toner from the plurality of photosensitive drum 40 into the waste toner box 5 without a member configured to collect the waste toner from the plurality of discharge parts 41 and to convey the same into the waste toner box 5.

Also, as shown in FIG. 9, in the state where the waste toner box 5 is located at the second position, the plurality of coupling parts 50K, 50Y, 50M, 50C and the plurality of discharge parts 41 are decoupled (refer to FIG. 7). As a result, it is possible to secure the smooth movement of the drawer 3 while accommodating the waste toner from the plurality of photosensitive drums 40 into the waste toner box 5.

What is claimed is:

1. An image forming apparatus comprising:

a main body;

a drawer movable between an inner position where the drawer is located inside the main body and an outer position where the drawer is located outside the main body;

a first cartridge detachably attached to the drawer and including a first photosensitive drum;

a first toner box configured to supply toner to the first cartridge, the first toner box movably supported by the main body and movable between a first posture where the first toner box is coupled with the first cartridge and a second posture where the first toner box is decoupled with the first cartridge;

a second cartridge detachably attached to the drawer and including a second photosensitive drum; and a second toner box configured to supply toner to the second cartridge, the second toner box movably supported by the main body and movable between a third posture where the second toner box is coupled with the second cartridge and a fourth posture where the second toner box is decoupled with the second cartridge;

wherein the drawer is movable from the inner position to the outer position when the first toner box is located in the second posture and the second toner box is located in the fourth posture, while the drawer is immovable from moving from the inner position to the outer position when the first toner box is located in the first posture and the second toner box is located in the third posture.

2. The image forming apparatus according to claim 1, wherein the first toner box and the second toner box are rotatable about an axis extending in an axis direction where the first toner box and the second toner box are arranged.

3. The image forming apparatus according to claim 2, wherein the first cartridge includes a first receiving part, and the first toner box includes a first supply device configured to couple with the first receiving part, wherein the second cartridge includes a second receiving part, and the second toner box includes a second supply device configured to couple with the second receiving part.

4. The image forming apparatus according to claim 3, wherein the first toner box is rotatable between the first posture where the first supply device of the first toner box is coupled with the first receiving part of the first cartridge and the second posture where the first supply device of the first toner box is decoupled with the first receiving part of the first cartridge, wherein the second toner box is rotatable between the third posture where the second supply device of the second toner box is coupled with the second receiving part of the second cartridge and the fourth posture where the second supply device of the second toner box is decoupled with the second receiving part of the second cartridge.

5. The image forming apparatus according to claim 4, where the first toner box at the second posture is located more distant from the first cartridge than at the first posture, where the second toner box at the fourth posture is located more distant from the second cartridge than at the third posture.

6. The image forming apparatus according to claim 3, wherein the first cartridge further comprises a first discharge part configured to discharge waste toner removed from the first photosensitive drum;

wherein the second cartridge further comprises a second discharge part configured to discharge waste toner removed from the second photosensitive drum, wherein the image forming apparatus further comprises a waste toner box comprising a first coupling part configured to be coupled with the first discharge part and a second coupling part configured to be coupled with the second discharge part, the waste toner box is movable between:

a first position where the first coupling part and the first discharge part are coupled and the second coupling part and the second discharge part are coupled; and a second position where the first coupling part and the first discharge part are decoupled and the second coupling part and the second discharge part are decoupled, and wherein the waste toner box is separatable from the main body in a case the waste toner box is located at the second position.

7. The image forming apparatus according to claim 2, wherein the drawer is movable between the inner position and the outer position in the axis direction.

8. The image forming apparatus according to claim 2, wherein the axis is disposed outside the first toner box and the second toner box.

9. The image forming apparatus according to claim 1, wherein at least one of the first toner box or the second toner box includes an auger.

10. The image forming apparatus according to claim 1, wherein the first cartridge comprises:

a developing device comprising a developing roller, the developing device being disposed so that the developing roller faces the first photosensitive drum;

a frame configured to rotatably support the first photosensitive drum and to swingably support the developing device; and an elastic member disposed between the developing device and the frame.

11. The image forming apparatus according to claim 1, wherein the first cartridge includes a first receiving part, and the first toner box includes a first supply device configured to couple with the first receiving part, and wherein the second cartridge includes a second receiving part, and the second toner box includes a second supply device configured to couple with the second receiving part.

12. The image forming apparatus according to claim 11, wherein the first toner box is movable between the first posture where the first supply device of the first toner box is coupled with the first receiving part of the first cartridge and the second posture where the first supply device of the first toner box is decoupled with the first receiving part of the first cartridge, and wherein the second toner box is movable between the third posture where the second supply device of the second toner box is coupled with the second receiving part of the second cartridge and the fourth posture where the second supply device of the second toner box is decoupled with the second receiving part of the second cartridge.

13. An image forming apparatus comprising:

a main body;

a drawer movable between an inner position where the drawer is located inside the main body and an outer position where the drawer is located outside the main body;

a first cartridge detachably attached to the drawer and including a first photosensitive drum;

a first toner box configured to supply toner to the first cartridge, the first toner box movably supported by the main body and movable between a first posture and a second posture;

a second cartridge detachably attached to the drawer and including a second photosensitive drum; and a second toner box configured to supply toner to the second cartridge, the second toner box movably supported by the main body and movable between a third posture and a fourth posture;

wherein the drawer is movable from the inner position to the outer position when the first toner box is located in the second posture and the second toner box is located in the fourth posture, while the drawer is immovable from moving from the inner position to the outer position when the first toner box is located in the first posture and the second toner box is located in the third posture, wherein the first toner box and the second toner box are rotatable about an axis extending in an axis direction where the first toner box and the second toner box are arranged, and wherein the drawer is movable between the inner position and the outer position in the axis direction.

14. An image forming apparatus comprising:

a main body;

a drawer movable between an inner position where the drawer is located inside the main body and an outer position where the drawer is located outside the main body;

a first cartridge detachably attached to the drawer and including a first photosensitive drum;

a first toner box configured to supply toner to the first cartridge, the first toner box movably supported by the main body and movable between a first posture and a second posture;

a second cartridge detachably attached to the drawer and including a second photosensitive drum; and a second toner box configured to supply toner to the second cartridge, the second toner box movably supported by the main body and movable between a third posture and a fourth posture;

wherein the drawer is movable from the inner position to the outer position when the first toner box is located in the second posture and the second toner box is located in the fourth posture, while the drawer is immovable from moving from the inner position to the outer position when the first toner box is located in the first posture and the second toner box is located in the third posture, wherein the first cartridge includes a first receiving part, and the first toner box includes a first supply device configured to couple with the first receiving part, wherein the second cartridge includes a second receiving part, and the second toner box includes a second supply device configured to couple with the second receiving part, wherein the first toner box is movable between the first posture where the first supply device of the first toner box is coupled with the first receiving part of the first cartridge and the second posture where the first supply device of the first toner box is decoupled with the first receiving part of the first cartridge, and wherein the second toner box is movable between the third posture where the second supply device of the second toner box is coupled with the second receiving part of the second cartridge and the fourth posture where the second supply device of the second toner box is decoupled with the second receiving part of the second cartridge.

* * * * *